US009423708B2

(12) United States Patent
Tominaga et al.

(10) Patent No.: US 9,423,708 B2
(45) Date of Patent: Aug. 23, 2016

(54) METHOD FOR PRODUCING TONER PARTICLE

(71) Applicant: CANON KABUSHIKI KAISHA, Tokyo (JP)

(72) Inventors: Tsuneyoshi Tominaga, Suntou-gun (JP); Kunihiko Nakamura, Gotemba (JP); Akane Masumoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/663,261

(22) Filed: Mar. 19, 2015

(65) Prior Publication Data

US 2015/0277251 A1 Oct. 1, 2015

(30) Foreign Application Priority Data

Mar. 27, 2014 (JP) ..... 2014-067127
Sep. 30, 2014 (JP) ..... 2014-199727

(51) Int. Cl.
*G03G 5/00* (2006.01)
*G03G 9/08* (2006.01)
*G03G 9/087* (2006.01)

(52) U.S. Cl.
CPC ..... *G03G 9/0804* (2013.01); *G03G 9/0802* (2013.01); *G03G 9/08762* (2013.01); *G03G 9/08795* (2013.01)

(58) Field of Classification Search
CPC ..... G03G 9/0804; G03G 9/08762; G03G 9/08795; G03G 9/0802
USPC ..... 430/137.11, 137.12, 137.14
See application file for complete search history.

(56) References Cited

U.S. PATENT DOCUMENTS

| | | | |
|---|---|---|---|
| 5,066,559 | A | 11/1991 | Elmasry et al. |
| 5,328,795 | A | 7/1994 | Yamashiro et al. |
| 7,157,539 | B2 | 1/2007 | Sato et al. |
| 7,866,806 | B2 | 1/2011 | Sato et al. |
| 8,288,069 | B2 | 10/2012 | Fujikawa et al. |
| 8,372,573 | B2 | 2/2013 | Ayaki et al. |
| 8,551,680 | B2 | 10/2013 | Ayaki et al. |
| 9,098,002 | B2 | 8/2015 | Kenmoku et al. |
| 2013/0164673 | A1 | 6/2013 | Yoshida et al. |

FOREIGN PATENT DOCUMENTS

| | | | |
|---|---|---|---|
| JP | 2-256071 | A | 10/1990 |
| JP | 4-212971 | A | 8/1992 |
| JP | 2004-176036 | A | 6/2004 |
| JP | 2005-281660 | A | 10/2005 |
| JP | 2011-137967 | A | 7/2011 |
| JP | 2012-256043 | A | 12/2012 |
| JP | 2013-152444 | A | 8/2013 |
| JP | 2014-2310 | A | 1/2014 |

OTHER PUBLICATIONS

U.S. Appl. No. 14/707,770, filed May 8, 2015. Inventor: Tominaga, et al.

*Primary Examiner* — Thorl Chea
(74) *Attorney, Agent, or Firm* — Fitzpatrick, Cella, Harper & Scinto

(57) ABSTRACT

A method for producing a toner particle having high charging stability and durability under environments at high temperature and high humidity is provided.
A method for producing a toner particle including an step of adhering a resin particle to surface of a toner base particle containing a binder resin and a colorant in an aqueous medium, wherein the resin particle contain a resin having an ionic functional group and having an acid dissociation constant pKa of 6.0 or more and 9.0 or less, and the pH (hydrogen ion concentration) of the aqueous medium is equal to or greater than pKa of the resin particle−2.0.

12 Claims, 2 Drawing Sheets

METHOD FOR PRODUCING TONER PARTICLE

BACKGROUND OF THE INVENTION

1. Field of the Invention

The present invention relates to a method for producing a toner particle for developing electrostatically charged images in an image forming method, such as electrophotography or electrostatic printing.

2. Description of the Related Art

Recently, copiers and printers have been used in a variety of regions, and have been also used under severer environments at high temperature and high humidity, which readily reduce the amount of charging. Printers using a high-speed one-component developing scheme have been also used to satisfy requirements for a reduction in size, an increase in speed, and higher stabilization. The toner for the one-component developing scheme contacts a charging member less frequently compared to the toner for the two-component developing scheme using a carrier. Accordingly, a relatively large stress should be applied to the toner for the one-component developing scheme to be charged at a predetermined amount of charging, leading to a large load on the toner.

A toner having higher functions given by adhering a resin particle having a variety of functions to the surface of a toner base particle has been proposed. The toner can surely attain a modified surface to enhance durability, charging properties, heat resistance and the like.

Japanese Patent Application Laid-Open No. 2014-002310 has proposed a toner prepared by aggregating and fusing resin particles prepared through a phase inversion emulsion step on the surfaces of core particles. In this disclosure, the resin particles are present on the outermost surface of the toner. Such resin particles unevenly distributed may readily drop off, leading to inferior durability. The resin particles also have insufficient charging stability under a highly humid environment, which may reduce image density under a highly humid environment.

To efficiently attain a charging effect even under a highly humid environment, Japanese Patent Application Laid-Open No. 2011-137967 has proposed a toner having a surface to which resin particles containing a unit having a salicylic acid-based substituent are adhered. Unfortunately, the adhesion state of the resin particles is not controlled in particular, so that aggregates of the resin particles may adhere to the surface of the toner to reduce the durability.

For such reasons, it has been desired that resin particles are uniformly adhered to the surfaces of toner base particles without aggregation of the resin particles to attain a toner having high charging stability and durability under environments at high temperature and high humidity.

SUMMARY OF THE INVENTION

An one embodiment of the present invention is directed to providing a method for producing a toner particle having high charging stability and durability under environments at high temperature and high humidity.

The object can be achieved by the following production method.

Namely, according to one aspect of the present invention, there is provided a method for producing a toner particle, including a step of adhering a resin particle to a surface of a toner base particle in an aqueous medium, the toner base particle containing a binder resin and a colorant, wherein the resin particle contains a resin A, the resin A (i) having an ionic functional group, and (ii) satisfying the following relationship $6.0 \leq pKa(A) \leq 9.0$ where the acid dissociation constant of the resin A is defined as pKa(A), and wherein when a pH of the aqueous medium at the start of the step is defined as pH(W), the pKa(A) and the pH(W) satisfy a following formula: $pH(W) \geq pKa(A) - 2.0$.

The present invention can provide a method for producing a toner particle having high charging stability and durability under environments at high temperature and high humidity.

Further features of the present invention will become apparent from the following description of exemplary embodiments with reference to the attached drawings.

DESCRIPTION OF THE EMBODIMENTS

Figure 1:
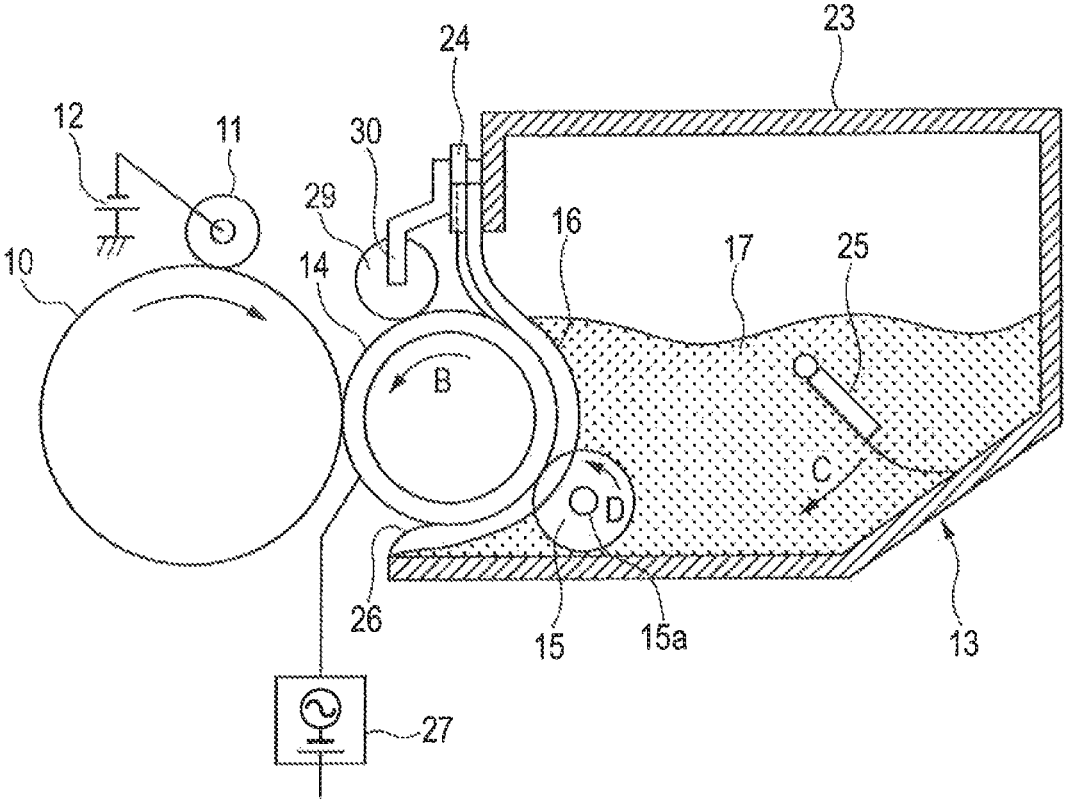
FIG. 1 is an enlarged view of a developing unit for an electrophotographic apparatus.

Preferred embodiments of the present invention will now be described in detail in accordance with the accompanying drawings.

The toner is charged by contact between the toner and a charging member, and therefore the toner should have a charge controlling agent on the outermost surface of the toner. Accordingly, a technique can be used for externally adhering particles containing a charge controlling agent to a toner base particle after production of the toner base particle.

The resin particle is adhered to the surface of the toner base particle by a known method. Since charged resin particles are dispersed in an aqueous medium, the present inventors have paid attention to a technique for adhering a resin particle to the surface of toner base particle in an aqueous medium.

The prevent inventors, who have conducted extensive research, have found that by control of the acid dissociation constant pKa of the resin having an ionic functional group contained in the resin particle and the pH (hydrogen ion concentration) of the aqueous medium, the resin particle having high charging performance can be uniformly adhered to the surface of toner base particle without aggregation of the resin particles.

Specifically, the present inventors have found a method for producing a toner particle, including an adhering step of adhering a resin particle to the surface of toner base particle containing a binder resin and a colorant in an aqueous medium, wherein the resin particle contains a resin (also referred to as a resin A) having an ionic functional group and a pKa of 6.0 or more and 9.0 or less, and the pH of the aqueous medium at the start of the adhering step is equal to or greater than pKa of the resin−2.0.

Namely, the resin satisfies $6.0 \leq pKa(A) \leq 9.0$ where the acid dissociation constant of the resin A is defined as pKa(A), and when the pH of the aqueous medium at the start of the adhering step is defined as pH(W), the pKa(A) and pH(W) satisfy a following formula: $pH(W) \geq pKa(A) - 2.0$.

As a result, the present inventors have achieved a toner having high charging stability and durability under environments at high temperature and high humidity.

The resin contained in the resin particle used in the adhering step will now be described.

The resin particle should contain a resin having an ionic functional group and an acid dissociation constant pKa of 6.0 or more and 9.0 or less.

The dissociation of the ionic functional group in the resin can be readily controlled in an aqueous medium. The dissociation of the ionic functional group in the resin causes an appropriate repulsive force between the resin particles, which can attain the adhesion of the dispersed resin particle to the surface of toner base particle. The resin has a pKa (=pKa(A)) preferably 7.0 or more and 8.5 or less, more preferably 7.0 or more and 8.0 or less.

A pKa(A) of less than 6.0 dissociates almost all ionic functional groups in the resin to enhance the resilience between the resin particles, leading to uneven adhesion of the resin particle to the surface of toner base particle. A pKa(A) of more than 9.0 barely dissociates the ionic functional groups in an aqueous medium, leading to aggregation of the resin particles.

The resin having a pKa(A) of 6.0 or more and 9.0 or less has high charging performance under a highly humid environment, which will be described.

Typically, the resin having an ionic functional group that is often used is a resin having a functional group such as a sulfonate group or a carboxyl group. Unfortunately, such a resin readily adsorbs moisture content, and may reduce the amount of charging under high temperature and high humidity. However, if the resin has an acid dissociation constant pKa of 6.0 or more and 9.0 or less, the resin has low moisture absorbing properties, and therefore can suppress a reduction in the amount of charging under a highly humid environment.

A resin having a pKa(A) of less than 6.0 significantly adsorbs moisture content to reduce the charging properties under high humidity. A resin having a pKa(A) of more than 9.0 leads to a low charging ability, so that the toner cannot be sufficiently charged.

The acid dissociation constant pKa can be determined from the result of neutralization titration described later.

The resin having an ionic functional group can be any resin having a pKa satisfying the range above. For example, resins having a hydroxyl group bonded to an aromatic ring and resins having a carboxyl group bonded to an aromatic ring can have a pKa within the range above.

For example, preferred are resins prepared by polymerization of vinylsalicylic acid, phthalic acid-1-vinyl, vinylbenzoic acid and 1-vinylnaphthalene-2-carboxylic acid.

A polymer A having a monovalent group a represented by Structural formula (1) as a molecular structure is more preferred.

formula (1)

(1)

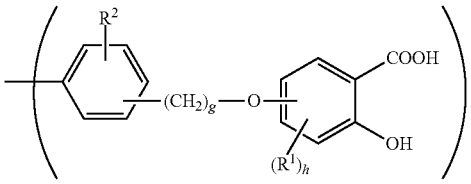

wherein $R^1$ represents a hydroxy group, a carboxy group, an alkyl group having 1 or more and 18 or less carbon atoms, or an alkoxy group having 1 or more and 18 or less carbon atoms; $R^2$ represents a hydrogen atom, a hydroxy group, an alkyl group having 1 or more and 18 or less carbon atoms, or an alkoxy group having 1 or more and 18 or less carbon atoms; g represents an integer of 1 or more and 3 or less; h represents an integer of 0 or more and 3 or less; and when h is 2 or 3, h of $R^1$ may be the same or different.

Examples of the alkyl group for $R^1$ and $R^2$ include a methyl group, an ethyl group, a propyl group, an isopropyl group, a butyl group, an isobutyl group, a s-butyl group and a t-butyl group. Examples of the alkoxy group for $R^1$ and $R^2$ include a methoxy group, an ethoxy group and a propoxy group.

The polymer A can have any main chain structure without limitation. Examples of the polymer A include vinyl polymers, polyester polymers, polyamide polymers, polyurethane polymers and polyether polymers. Examples thereof also include hybrid polymers of combinations of these polymers. Among these polymers, vinyl polymers are preferred in view of the tight adhesion to the toner base particle.

The content of the monovalent group a represented by Structural formula (1) contained in the polymer A can be 50 μmol/g or more and 1000 μmol/g or less. A content of 50 μmol/g or more can attain high charging properties and durability. A content of 1000 μmol/g or less can suppress charge up.

The content of the monovalent group a represented by Structural formula (1) in the polymer A can determined by the following method. First, the acid value of the polymer A is determined by titration of the polymer A according to the method described below, and the amount of carboxy group derived from the monovalent group a represented by Structural formula (1) in the polymer A is calculated. From the calculated content, the content (μmol/g) of the monovalent group a represented by Structural formula (1) in the polymer A can be calculated. If the polymer A has a carboxy group in a site other than the monovalent group a represented by Structural formula (1), the acid value of a compound (for example, polyester resin) immediately before addition reaction of the monovalent group a represented by Structural formula (1) is preliminarily determined in the preparation of the polymer A. The amount of the monovalent group a represented by Structural formula (1) to be added can be calculated from the difference between the preliminarily determined acid value and the acid value of the polymer A after the addition reaction.

Alternatively, the polymer A is measured by NMR. From the integrated values derived from the characteristic chemical shift values of the monomer components, the molar ratio of the components can be calculated. From the molar ratio, the content (μmol/g) can be calculated.

Next, the pH (hydrogen ion concentration) of the aqueous medium in the adhering step will be described. In the step (adhering step) of adhering the resin particle used in the present invention to the surface of the toner base particle in an aqueous medium, the pH (hydrogen ion concentration) of the aqueous medium should be equal to or greater than pKa of the resin particle−2.0.

Since the resin A contained in the resin particle used in the present invention has an acid dissociation constant pKa (=pKa(A)) of 6.0 or more and 9.0 or less, the dissociation of the ionic functional group in the resin particle depends on the pH of the aqueous medium. If an aqueous medium having a low pH barely dissociates the ionic functional group, probably most of the surface of the resin particle are not charged, and the resin particles readily contact with each other to form aggregates. Such aggregates adhere to the surface of the toner base particle. In such an adhesion state, if toner particle or the toner and a charging member are brought into contact, the aggregates of the resin particles readily drop off from the toner base particle to reduce the charging stability. Furthermore, the dropped aggregates of the resin particles may contaminate the member to reduce durability. The present inventors, who have conducted extensive research, have found that if an aqueous medium has a pH equal to or greater than pKa(A)−2.0, the resin particle can be adhered while the resin particle is being dispersed. A pH in this region can suppress the aggregation of the resin particles to attain uniform and firm adhesion of the resin particle to the toner base particle. Such adhesion can keep high charging stability of the resin particle for a long time. In contrast, if an aqueous medium has a pH of less than pKa(A)−2.0, the ionic functional groups in the resin particle barely dissociate, and the aggregated resin particles adhere to the surface of the toner base particle. Accordingly, the pH of the aqueous medium is preferably equal to or higher than pKa(A). To prevent excess dissociation of the ionic functional group, the pH of the aqueous medium is more preferably pKa(A)+4.0 or more. Namely, pKa(A)−2.0≤pH(W)≤pKa(A)+4.0 can be satisfied.

The control of the pH(W) to be equal to or greater than pKa(A)−2.0 can involve a pH controlling step of controlling the pH of the aqueous medium with a pH controlling agent containing at least one selected from the group consisting of acids having an acid dissociation constant pKa of 3.0 or less and bases having a base dissociation constant (pKb) of 3.0 or less. A small amount of such acids and bases can precisely control the pH of the aqueous medium. In an acid having a pKa of more than 3.0 and a base having a pKb of more than 3.0, large amounts may be required for the control of the pH. Such large amounts of the acid and the base may reduce the contact between the toner base particle and the resin particle in the aqueous medium, resulting in uneven adhesion. Although the pKa values and the pKb values are not specified in some strong acids and some strong bases, apparently strong acids have a pKa of 3.0 or less and strong bases have a pKb of 3.0 or less. Accordingly, these strong acids and strong bases are included in the acid having a pKa of 3.0 or less and the base having a pKb of 3.0 or less, respectively. In the pH controlling agent, the pKa value and the pKb value each represent the dissociation constant in water.

Examples of the acid having an acid dissociation constant pKa of 3.0 or less include hydrochloric acid, bromic acid, iodic acid, perchloric acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerophosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid and malonic acid.

Among these acids, preferred are monovalent acids, which readily control the pH. Among these monovalent acids, hydrochloric acid and nitric acid are particularly preferred.

Examples of the base having a base dissociation constant (pKb) of 3.0 or less include lithium hydroxide, sodium hydroxide, potassium hydroxide, rubidium hydroxide, cesium hydroxide, tetramethylammonium hydroxide, tetraethylammonium hydroxide, calcium hydroxide, strontium hydroxide, barium hydroxide, magnesium hydroxide, europium hydroxide, thallium hydroxide and guanidine.

Among these bases, preferred are monovalent bases, which readily dissociate the ionic functional group in the resin particle. Among these monovalent bases, lithium hydroxide, sodium hydroxide and potassium hydroxide are particularly preferred. A base not concerned with the control of the pH can also be added. Alternatively, an acid and a base may be used in combination.

An aqueous medium having a pH equal to or greater than pKa(A)−2.0 without the control of the pH can be used in the adhesion without undergoing the pH controlling step.

The toner according to the present invention can contain any binder resin without limitation. Examples of the binder resin include: styrene resins, acrylic resins, methacrylic resins, styrene-acrylic resins, styrene-methacrylic resins, polyethylene resins, polyethylene-vinyl acetate resins, vinyl acetate resins, polybutadiene resins, phenol resins, polyurethane resins, polybutyral resins, polyester resins and hybrid resins in which any of the above resins are combined. Among these binder resins, the following can be desirably used in view of the properties of the toner: styrene resins, acrylic resins, methacrylic resins, styrene-acrylic resins, styrene-methacrylic resins, polyester resins, or hybrid resins obtained by combining styrene-acrylic resins or styrene-methacrylic resins and polyester resins.

The polyester resin usable is a polyester resin typically produced with polyhydric alcohol and carboxylic acid, carboxylic anhydride or carboxylic acid ester as raw material monomers. Specifically, the same polyhydric alcohol component and the same polyvalent carboxylic acid component as those in the polyester resin can be used. Among these components, particularly preferred is a polyester resin prepared by condensation polymerization of the following components. Examples of a diol component include bisphenol derivatives. Examples of an acid component include carboxylic acid components such as di- or higher valent carboxylic acids or acid anhydrides thereof; and lower alkyl esters of fumaric acid, maleic acid, maleic anhydride, phthalic acid, terephthalic acid, trimellitic acid and pyromellitic acid.

The toner according to the present invention can also be used as a magnetic toner. In this case, the following magnetic substances are used. Examples of the magnetic substance include iron oxides such as magnetite, maghemite and ferrite, or iron oxides containing other metal oxides; metals such as Fe, Co and Ni, alloys of these metals and metals such as Al, Co, Cu, Pb, Mg, Ni, Sn, Zn, Sb, Ca, Mn, Se and Ti, and mixtures thereof; triiron tetraoxide ($Fe_3O_4$), diiron trioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$) and manganese iron oxide ($MnFe_2O_4$) These magnetic materials are used singly or in combinations of two or more. Particularly suitable magnetic materials are fine powders of triiron tetraoxide or $\gamma$-diiron trioxide.

These magnetic substances each have an average particle diameter of preferably 0.1 μm or more and 2.0 μm or less, more preferably 0.1 μm or more and 0.3 μm or less. For the magnetic properties under application of 795.8 kA/m (10 kOe), the coercivity (Hc) is 1.6 kA/m or more and 12 kA/m or less (20 Oe or more and 150 Oe or less), and the saturation magnetization ($\sigma s$) is 5 $Am^2/kg$ or more and 200 $Am^2/kg$ or less. The saturation magnetization is preferably 50 $Am^2/kg$ or more and 100 $Am^2/kg$ or less. The residual magnetization ($\sigma r$) can be 2 $Am^2/kg$ or more and 20 $Am^2/kg$ or less.

The magnetic substance can be used in an amount of 10.0 parts by mass or more and 200 parts by mass or less, preferably 20.0 parts by mass or more and 150 parts by mass or less relative to 100 parts by mass of binder resin.

If the toner according to the present invention is used as a non-magnetic toner, known colorants such as various traditionally known dyes and pigments can be used.

Examples of coloring pigments for magenta include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:1, 48:2, 48:3, 48:4, 48:5, 49, 50, 51, 52, 53, 54, 55, 57:1, 58, 60, 63, 64, 68, 81:1, 81:2, 81:3, 81:4, 81:5, 83, 87, 88, 89, 90, 112, 114, 122, 123, 146, 147, 150, 163, 184, 185, 202, 206, 207, 209, 238, 269 and 282; C.I. Pigment Violet 19; and C.I. Vat Reds 1, 2, 10, 13, 15, 23, 29 and 35. These pigments can be used alone or in combination with dyes.

Examples of coloring pigments for cyan include copper phthalocyanine compounds and derivatives thereof; anthraquinone compounds; and basic dye lake compounds. Specific examples thereof include C.I. Pigment Blues 1, 7, 15, 15:1, 15:2, 15:3, 15:4, 60, 62 and 66.

Examples of coloring pigments for yellow include compounds such as condensation azo compounds, isoindolinone compounds, anthraquinone compounds, azo metal complexes, methine compounds and allylamide compounds. Specific examples thereof include C.I. Pigment Yellows 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellows 1, 3 and 20.

Examples of usable black colorants include carbon black, aniline black, acetylene black, titanium black, and colorants toned to a black color by using the yellow, magenta, and cyan colorants listed above.

The toner according to the present invention may contain a mold release agent. Examples of the mold release agent include aliphatic hydrocarbon waxes such as low molecular weight polyethylene, low molecular weight polypropylene, microcrystalline wax and paraffin wax; oxides of aliphatic hydrocarbon waxes such as oxidized polyethylene wax; block copolymers of aliphatic hydrocarbon waxes; waxes mainly containing fatty acid esters such as carnauba wax, Sasolwax and montanic acid ester wax; and partially or completely deoxidized fatty acid esters such as deoxidized carnauba wax; partially esterified products of fatty acids such as monoglyceride behenate and polyhydric alcohol; and methyl ester compounds having a hydroxyl group prepared by hydrogenation of vegetable oils and fats.

In the molecular weight distribution of the mold release agent, the main peak is within the region of a molecular weight of preferably 400 or more and 2400 or less, more preferably 430 or more and 2000 or less. Such a mold release agent can give preferred thermal properties to the toner. The mold release agent is added in a total amount of preferably 2.50 parts by mass or more and 40.0 parts by mass or less, more preferably 3.00 parts by mass or more and 15.0 parts by mass or less relative to 100 parts by mass of binder resin.

The toner particle may contain a fluidity improver as an external additive.

Examples of the fluidity improver include fluorine resin powders such as vinylidene fluoride fine powders and polytetrafluoroethylene fine powders; silica fine powders such as silica fine powders prepared by a wet method and silica fine powders prepared by a dry method; treated silica fine powders prepared by surface treating these silica fine powders with a treatment agent such as a silane coupling agent, a titanium coupling agent or a silicone oil; titanium oxide fine powders; alumina fine powders; treated titanium oxide fine powders; and treated alumina oxide fine powders. A fluidity improver having a specific surface area of 30.0 $m^2/g$ or more, preferably 50.0 $m^2/g$ or more determined by nitrogen adsorption according to a BET method can attain favorable results. The fluidity improver is added in an amount of preferably 0.010 parts by mass or more and 8.0 parts by mass or less, more preferably 0.10 parts by mass or more and 4.0 parts by mass or less relative to 100 parts by mass of toner particles.

The method for producing a toner particle according to the present invention can include a dispersion liquid preparing step of dispersing a toner base particle in an aqueous medium to prepare a dispersion liquid of the toner base particle, a pH controlling step, and a resin particle adding step of adding a resin particle to the aqueous medium, and an adhering step. A method including these steps in this order can uniformly adhere the resin fine particle to the surface of the toner base particle.

The dispersion liquid preparing step will now be described.

The toner base particle can be produced by any known traditional method such as suspension polymerization, dissolution suspension, emulsion aggregation and grinding. Among these methods, the toner base particle is produced particularly preferably by suspension polymerization. Suspension polymerization will be described later. The toner base particle produced in the aqueous medium may be used as they are in the subsequent step, or may be subjected to washing, filtration and drying, and be dispersed again in the aqueous medium. The toner base particle produced by a dry method can be dispersed in an aqueous medium by a known method. The aqueous medium can contain a dispersion stabilizer to disperse the toner base particle in the aqueous medium.

A known inorganic or organic dispersion stabilizer can be used.

Examples of the inorganic dispersion stabilizer include: calcium phosphate compounds, aluminum phosphate compounds, magnesium phosphate compounds, calcium hydroxide compounds, aluminum hydroxide compounds, magnesium hydroxide compounds, calcium carbonate compounds, aluminum carbonate compounds, magnesium carbonate compounds, calcium metasilicate compounds, calcium sulfate compounds, barium sulfate compounds, bentonite, silica and alumina.

Examples of the organic dispersion stabilizer include: polyvinyl alcohol, gelatin, methyl cellulose, methyl hydroxypropyl cellulose, ethyl cellulose, sodium salts of carboxymethyl cellulose, and starch.

Other examples of the dispersion stabilizer usable include commercially available nonionic, anionic and cationic surfactants. Examples of such surfactants include: sodium dodecyl sulfate, sodium tetradecyl sulfate, sodium pentadecyl sulfate, sodium octyl sulfate, sodium oleate, sodium laurate, potassium stearate and calcium oleate.

Among these dispersion stabilizers, preferred are inorganic dispersion stabilizers, which are readily removed from the toner particle. Use of such an inorganic dispersion stabilizer can facilitate washing off with an acid or a base to reduce the amount of the residual in the toner particle.

More preferably, the inorganic dispersion stabilizer is at least one selected form the group consisting of a calcium phosphate compound, an aluminum phosphate compound, a magnesium phosphate compound, a calcium hydroxide compound, an aluminum hydroxide compound, a magnesium hydroxide compound, a calcium carbonate compound, an aluminum carbonate compound and a magnesium carbonate compound.

The inorganic dispersion stabilizer can be a commercially available inorganic dispersion stabilizer, which can be used as it is. Alternatively, the inorganic dispersion stabilizer can be produced in an aqueous medium under high-speed stirring to attain particles of the inorganic dispersion stabilizer having a fine and uniform particle size. For example, if a calcium phosphate compound is used as the dispersion stabilizer, a sodium phosphate aqueous solution is mixed with a calcium chloride aqueous solution under high-speed stirring to form fine particles of a calcium phosphate compound.

The dispersion stabilizer can be used in an amount of 0.1 parts by mass or more and 5.0 parts by mass or less relative to 100.0 parts by mass of toner base particles.

Next, the pH controlling step will be described.

The pH controlling step can be performed before the resin particle adding step of adding resin particles to an aqueous medium. The control of the pH of the aqueous medium before the addition of the resin particles to the aqueous medium can prevent aggregation of the resin particles.

The resin particle adding step will then be described.

In the resin particle adding step, the resin particles are added while the dispersion liquid of toner base particle is being stirred. In the resin particle adding step, the temperature of the aqueous medium can be lower than the glass transition temperature of the resin particle when the resin particles are added to the aqueous medium. Such a temperature of the aqueous medium can prevent aggregation of the resin particles when added to the aqueous medium.

The adhering step will now be described.

The resin particle can be adhered by a known technique if the pH (=pH(W)) of the aqueous medium is controlled to be equal to or greater than pKa(A)−2.0 before the adhering step. For example, after the resin particles are added to the dispersion liquid of toner base particle, the resin particle may be embedded into the base particle by a mechanical impact, or the resin particle may be adhered to the base particle by heating the aqueous medium. Alternatively, the resin particle may be adhered to the base particle by addition of a flocculant. A combination of these techniques can also be used. In any technique, the aqueous medium can be stirred.

More preferred is a technique for heating the aqueous medium to a temperature equal to or higher than the glass transition temperature of the toner base particle to firmly adhere the resin particle to the toner base particle. The aqueous medium at the temperature above softens the toner base particle, which fix the toner particle upon contact therewith.

In the adhering step, the toner base particle can have a zeta potential higher than the zeta potential of the resin particle by 10 mV or more. If the toner base particle has a zeta potential larger than the zeta potential of the resin particle by 10 mV or more, the resin particles electrostatically adhere to the toner base particles. Such electrostatic adhesion can attain adhesion in a short time, and reduce fluctuation in particles.

The zeta potential of the toner base particle can be controlled by the dispersion stabilizer listed above. Specifically, the control of the zeta potential can be attained by the type and amount of dispersion stabilizer applied to the surfaces of the toner base particles or the applying method.

After the adhesion of the resin particle to the surface of the toner base particle, the product is filtered, is washed, and is dried by known methods to prepare a toner particle. The inorganic dispersion stabilizer, if used, can be dissolved with an acid or a base, and is removed.

The resin particle can be prepared by any method. For example, a resin particle produced by a known method such as emulsion polymerization, soap-free emulsion polymerization, phase inversion emulsion or mechanical emulsion can be used. Among these methods, phase inversion emulsion is preferred because a resin particle having smaller diameters is readily prepared without using an emulsifier or a dispersion stabilizer.

Phase inversion emulsion uses a self-dispersible resin or a resin which can be self-dispersible by neutralization. A resin having a hydrophilic group in the molecule can be self-dispersible in an aqueous medium. Specifically, a resin having an ionic functional group or a polyether group has high self-dispersibility.

In the present invention, the resin particle is produced with a resin having an ionic functional group which becomes self-emulsifiable by neutralization. Specifically, a resin having an ionic functional group and an acid dissociation constant pKa of 6.0 or more and 9.0 or less is used.

The neutralization of the ionic functional group in the resin can enhance the hydrophilicity to attain self-dispersion of the resin in an aqueous medium. Such a resin is dissolved in an organic solvent. A neutralizer is added, and is mixed with the aqueous medium with stirring. The resin dissolution solution is phase inversion emulsified to form fine particles. The organic solvent is removed by heating or reducing pressure after phase inversion emulsion. As described above, phase inversion emulsion can prepare a stable aqueous dispersion of resin particle substantially without an emulsifier or a dispersion stabilizer.

In the present invention, the resin particle has an average particle diameter of preferably 5 nm or more and 200 nm or less in terms of the volume-based median particle size (D50) determined by the measurement of particle size distribution according to a laser light scattering method. The average particle diameter is more preferably 20 nm or more and 130 nm or less. A volume-based median particle size (D50) of less than 5 nm may lead to insufficient durability. A volume-based median particle size (D50) of more than 200 nm may lead to uneven adhesion.

The resin particle can be adhered in an amount of 0.10 parts by mass or more and 5.0 parts by mass or less relative to 100 parts by mass of toner base particle. At an amount of 0.10 parts by mass or more, toner particle having adhesion uniformity is prepared to attain favorable charging properties and sufficient durability. At an amount of 5.0 parts by mass or less, high durability of the toner particle is ensured while image defects attributed to excess resin particles can be reduced. The amount of resin particle is more preferably 0.20 parts by mass or more and 3.0 parts by mass or less.

A method for producing a toner base particle by suspension polymerization will now be described in detail.

In a method for producing a toner base particle according to the present invention, toner base particle can be prepared by forming a polymerizable monomer composition containing a polymerizable monomer and a colorant into particles in an aqueous medium, and polymerizing the polymerizable monomer contained in the particles of the polymerizable monomer composition.

First, a polymerizable monomer composition containing a polymerizable monomer and a colorant is added to an aqueous medium, and is formed into particles of the polymerizable monomer composition in the aqueous medium. More specifically, the colorant is added to the polymerizable monomer as the main material for toner base particle, and is uniformly dissolved or dispersed with a dispersing machine such as a homogenizer, a ball mill, a colloid mill or an ultrasonic dispersing machine to prepare a polymerizable monomer composition. At this time, additives such as a polyfunctional monomer, a chain transfer agent, a mold release agent, a charge control agent, a plasticizer and a dispersant can be properly added to the polymerizable monomer composition when necessary.

Next, the polymerizable monomer composition is added to the aqueous medium containing the dispersion stabilizer, which is preliminarily prepared, and is suspended with a high-speed dispersing machine such as a high-speed stirrer or an ultrasonic dispersing machine to perform granulation. A polymerization initiator may be mixed with other additives in the preparation of the polymerizable monomer composition, or may be mixed with the polymerizable monomer composition immediately before the suspension of the polymerizable monomer composition in the aqueous medium. Alternatively, a polymerization initiator can also be added in the form of a dissolution in a polymerizable monomer or another solvent, when necessary, during the granulation or after completion of the granulation, namely, immediately before the start of a polymerization reaction.

The particles of the polymerizable monomer composition are formed in the aqueous medium in this manner.

The suspension having dispersed particles of the polymerizable monomer composition is then heated to a temperature of 50° C. or higher and 90° C. or lower to perform a polymerization reaction with stirring while the particles of the polymerizable monomer composition contained in the suspension are kept as they are and floating or sedimentation of the particles are prevented.

The polymerization initiator readily decomposes by heating to generate radicals. The generated radicals are added to unsaturated bonds of the polymerizable monomer to further generate adducts of the radicals. The generated adducts of the radicals are further added to unsaturated bonds of the polymerizable monomer. Such a chain addition reaction is repeated to progress the polymerization reaction to form polymer particles (toner base particles) including the polymerizable monomer as the main material and prepare a dispersion liquid of the polymer particles (toner base particles).

After this reaction, a distillation step may be performed when necessary to remove the residual polymerizable monomer.

Examples of the polymerizable monomer used in suspension polymerization include:

styrenes such as styrene, o-methylstyrene, m-methylstyrene, p-methylstyrene, α-methylstyrene and derivatives thereof; ethylene unsaturated monoolefins such as ethylene, propylene, butylene and isobutylene; halogenated vinyls such as vinyl chloride, vinylidene chloride, vinyl bromide and vinyl fluoride; vinyl ester acids such as vinyl acetate, vinyl propionate and vinyl benzoate; acrylic acid esters such as n-butyl acrylate and 2-ethylhexyl acrylate; methacrylic acid esters such as n-butyl methacrylate and 2-ethylhexyl methacrylate; methacrylic acid amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinylpyrrole; vinylnaphthalenes; derivatives of acrylic acid or methacrylic acid such as acrylonitrile, methacrylonitrile and acrylamide; acrylic acid; and methacrylic acid. These polymerizable monomers can be used in combinations of two or more when necessary.

Examples of the polymerization initiator used in suspension polymerization include:

azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropylperoxy carbonate, cumene hydroperoxide, 2,4-dichlorobenzoyl peroxide, lauroyl peroxide and tert-butyl peroxypivalate.

The amount of the polymerization initiator to be used depends on the target degree of polymerization. The amount can be usually 3.0 parts by mass or more and 20.0 parts by mass or less relative to 100.0 parts by mass of the polymerizable monomer. The type of polymerization initiators slightly varies according to the polymerization method. These polymerization initiators selected with reference to a 10-hour half-life temperature are used singly or in the form of a mixture.

The methods of the measurements used in the present invention will now be described.

<Volume-Based Median Particle Size (D50) of Resin Particles>

The volume-based median particle size (D50) of resin particles is calculated from particle diameters measured with Zetasizer Nano-ZS (manufactured by Malvern Instruments Ltd.) by dynamic light scattering (DLS).

First, the apparatus is turned on, and the laser is allowed 30 minutes to stabilize. Zetasizer software is then activated.

"Manual" is selected from "Measure" menu, and measuring details are input as follows:

Measurement mode: particle diameter

Material: Polystyrene latex (RI: 1.59, Absorption: 0.01)

Dispersant: Water (Temperature: 25° C., Viscosity: 0.8872 cP, RI: 1.330)

Temperature: 25.0° C.

Cell: Clear disposable zeta cell

Measurement duration: Automatic

A sample is diluted with water to prepare a 0.50% by mass of sample. The sample is charged into a disposable capillary cell (DTS1060), and the cell is mounted on the cell holder of the apparatus.

If ready, "Start" button on a measurement display screen is pressed to start measurement.

D50 is calculated from data on the volume-based particle size distribution converted from the light intensity distribution, which is determined by the DLS measurement, by Mie theory.

<Zeta Potential>

The zeta potential is measured with Zetasizer Nano-ZS (manufactured by Malvern Instruments Ltd.). A sample is diluted with water to prepare a 0.50% by mass of dispersion liquid. Next, the pH of the sample is controlled with a 0.1 mol/L sodium hydroxide aqueous solution or a 0.1 mol/L hydrochloric acid aqueous solution to have the same pH as the pH specified in the adhering step. The sample having the controlled pH is charged into a disposable capillary cell (DTS1060), and the cell is mounted on the cell holder of the apparatus. If ready, the temperature condition is set to the temperature for adhering, and the measurement is performed.

<Glass Transition Temperature (Tg)>

The glass transition temperature (Tg) of the toner base particle and that of the resin particle are measured with a differential scanning calorimeter (DSC) M-DSC (trade name: Q2000, manufactured by TA Instruments-Waters LLC) according to the following procedure. A sample (3 mg) to be measured is precisely weighed. The sample is placed in an aluminum pan, and an empty aluminum pan is used as a reference. The measurement is performed in the measurement temperature ranging from 20 to 200° C. at a temperature raising rate of 1° C./min at normal temperature and normal humidity. At this time, the modulation amplitude±0.5° C. is measured at a frequency of 1/min. From the resulting reversing heat flow curve, the glass transition temperature (Tg: ° C.) is calculated. Tg (° C.) is a temperature in a midpoint of the straight line connecting the intersection of each base line before and after the endotherm and tangent line drawing at the point indicated maximum of a gradient of step-like change region in a curved line by the endotherm.

<Acid Value>

The acid value indicates the amount of potassium hydroxide (mg) needed to neutralize an acid contained in 1 g of a sample. In the present invention, the acid value is measured according to JIS K 0070-1992, specifically according to the following procedure.

Titration is performed with a 0.1 mol/L potassium hydroxide ethyl alcohol solution (manufactured by KISHIDA CHEMICAL Co., Ltd.). The factor of the potassium hydroxide ethyl alcohol solution can be determined with a potentiometric titrator (potentiometric titrator AT-510 manufactured by Kyoto Electronics Manufacturing Co., Ltd.). A 0.100 mol/L hydrochloric acid (100 mL) is placed in a 250 mL tall beaker, and is titrated with the potassium hydroxide ethyl alcohol solution. The factor thereof is determined from the amount of the potassium hydroxide ethyl alcohol solution needed for neutralization. The 0.100 mol/L hydrochloric acid used is produced according to JIS K 8001-1998.

The acid value is measured under the following measurement conditions:

Titrator: potentiometric titrator AT-510 manufactured by Kyoto Electronics Manufacturing Co., Ltd.)

Electrode: composite glass electrode double-junction type (manufactured by Kyoto Electronics Manufacturing Co., Ltd.)

Software for controlling titrator: AT-WIN

Titration analysis software: Tview

During titration, titration parameters and control parameters are set as follows:

Titration Parameters

Titration mode: blank titration

Titration method: whole titration

Maximum amount of titration: 20 mL

Waiting time before titration: 30 seconds

Titration direction: automatic

Control Parameters

Potential at determination of end point: 30 dE

Potential value at determination of end point: 50 dE/dmL

Determination of detection of end point: not set

Control rate mode: standard

Gain: 1

Potential at collection of data: 4 mV

Amount of titration at collection of data: 0.1 mL

Main Test;

A sample for measurement (0.100 g) is precisely weighed, and is placed in a 250 mL tall beaker. A mixed solution (150 mL) of toluene/ethanol (3:1) is added to dissolve the sample over one hour. The sample is titrated with the potassium hydroxide ethyl alcohol solution using the potentiometric titrator.

Blank Test;

The titration is performed by the same operation as above without using the sample (namely, with using only a mixed solution of toluene/ethanol (3:1)).

The results are substituted into the following formula to calculate the acid values.

$$A=[(C-B)\times f\times 5.611]/S$$

where A represents an acid value (mgKOH/g), B represents the amount of the potassium hydroxide ethyl alcohol solution to be added (mL) in the blank test, C represents the amount of the potassium hydroxide ethyl alcohol solution to be added (mL) in the main test, f represents the factor of the potassium hydroxide solution, and S represents the sample (g).

<pKa>

A sample for measurement (0.100 g) is precisely weighed, and is placed in a 250 mL tall beaker. THF (150 mL) is added to dissolve the sample over 30 minutes. A pH electrode is placed in the solution to read the pH of the THF solution of the sample. Every time when a 0.1 mol/L potassium hydroxide ethyl alcohol solution (manufactured by KISHIDA CHEMICAL Co., Ltd.) is added in an amount of 10 μL, the pH of the solution is read, and titration is performed. The 0.1 mol/L potassium hydroxide ethyl alcohol solution is added until the pH reaches 10 or more and the pH no longer changes by further addition of 30 μL of the 0.1 mol/L potassium hydroxide ethyl alcohol solution. From the result, the pH is plotted against the amount of the 0.1 mol/L potassium hydroxide ethyl alcohol solution added to produce a titration curve. In the titration curve, the point having the largest inclination of change in pH is defined as a point of neutralization. pKa is determined as follows. The pH in the titration with a half of the amount of the 0.1 mol/L potassium hydroxide ethyl alcohol solution needed to reach the point of neutralization is read from the titration curve, and this read pH value is defined as pKa.

<NMR>

The content of the structure a contained in the polymer A is determined by nuclear magnetic resonance spectroscopy ($^1$H-NMR) [400 MHz, $CDCl_3$, room temperature (25° C.)].

Measurement apparatus: FT NMR apparatus JNM-EX400 (manufactured by JEOL Ltd.)

Frequency: 400 MHz

Pulse condition: 5.0 μs

Frequency range: 10500 Hz

The number of integrations: 64 times

From the integrated value of the spectrum, the molar ratio of the monomer components is determined. From the molar ratio, the content (mol %) of the structure a contained in the polymer A is calculated.

EXAMPLES

The present invention will now be specifically described by way of Examples, but the present invention will not be limited to these Examples. "Parts" indicate "parts by mass."

Synthetic Example of Polymerizable Monomer M-1

(Step 1)

2,5-Dihydroxybenzoic acid (100 g) and 80% sulfuric acid (1441 g) were heated to 50° C., and were mixed. tert-Butyl alcohol (144 g) was added to the dispersion liquid, and was stirred at 50° C. for 30 minutes. The operation, i.e., addition of tert-butyl alcohol (144 g) to the dispersion liquid followed by stirring for 30 minutes was then performed three times. The reaction solution was cooled to room temperature, and was slowly poured to ice water (1 kg). The precipitate was filtered, and was washed with water, then with hexane. The precipitate was dissolved in methanol (200 mL), and was reprecipitated in water (3.6 L). After filtration, the reaction product was dried at 80° C. to prepare a salicylic acid intermediate product (74.9 g) represented by Structural formula (4).

formula (4)

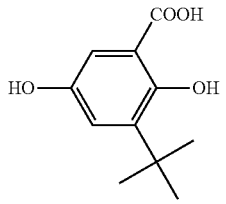

(Step 2)

The salicylic acid intermediate product (25.0 g) was dissolved in methanol (150 mL). Potassium carbonate (36.9 g) was added, and was heated to 65° C. A mixed solution of 4-(chloromethyl)styrene (18.7 g) and methanol (100 mL) was added dropwise to the reaction solution to perform a reaction at 65° C. for three hours. The reaction solution was cooled, and was filtered. The filtrate was condensed to prepare a crude product. The crude product was dispersed in water (1.5 L) at pH=2, and ethyl acetate was added for extraction. The extracted product was washed with water, and was dried with magnesium sulfate. Ethyl acetate was distilled off under reduced pressure to prepare a precipitate. The precipitate was washed with hexane, and was recrystallized with toluene and ethyl acetate to be purified. Polymerizable monomer M-1 (20.1 g) represented by Structural formula (5) was prepared.

formula (5)

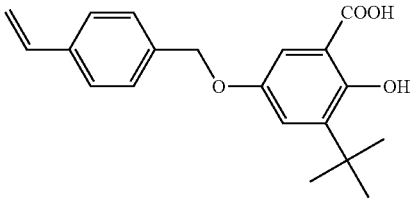

Synthetic Example of Polymerizable Monomer M-2

Polymerizable monomer M-2 represented by Structural formula (6) was prepared by the same method as in Synthesis of Polymerizable monomer M-1 (Step 2) except that the salicylic acid intermediate product represented by Structural formula (4) was replaced by 2,4-dihydroxybenzoic acid (18 g).

formula (6)

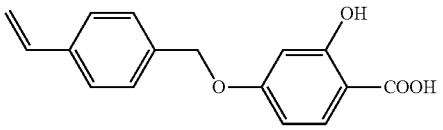

Synthetic Example of Polymerizable Monomer M-3

Polymerizable monomer M-3 represented by Structural formula (7) was prepared by the same method as in Synthesis of Polymerizable monomer M-1 (Step 2) except that the salicylic acid intermediate product represented by Structural formula (4) was replaced by 2,3-dihydroxybenzoic acid (18 g).

formula (7)

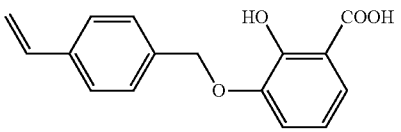

Synthetic Example of Polymerizable Monomer M-4

Polymerizable monomer M-4 represented by Structural formula (8) was prepared by the same method as in Synthesis of Polymerizable monomer M-1 (Step 2) except that the salicylic acid intermediate product represented by Structural formula (4) was replaced by 2,6-dihydroxybenzoic acid (18 g).

formula (8)

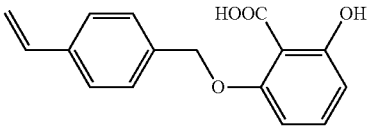

Synthetic Example of Polymer 1

Polymerizable monomer M-1 (9.9 g) represented by Structural formula (5) and styrene (60.1 g) were dissolved in DMF (42.0 mL), and were stirred for one hour while nitrogen gas was being bubbled. The solution was heated to 110° C. An initiator or a mixed solution of tert-butyl peroxyisopropyl monocarbonate (manufactured by NOF Corporation, trade name: Perbutyl I, 2.1 g) and toluene (42 mL) was added dropwise to the reaction solution. The reaction solution was further reacted at 110° C. for four hours. The reaction solution was then cooled, and was added dropwise to methanol (1 L) to prepare a precipitate. The precipitate was dissolved in THF (120 mL). The solution was added dropwise to methanol (1.80 L) to precipitate a white precipitate. The white precipitate was filtered, and was dried under reduced pressure at 90° C. to prepare Polymer 1 (57.6 g). Polymer 1 was measured by NMR and the acid value thereof was determined to determine the content of the component derived from Polymerizable monomer M-1.

Synthetic Examples of Polymers 2 to 6

Polymers 2 to 6 were prepared in the same manner as in Synthetic Example of Polymer 1 except that the amounts of raw materials used were varied as shown in Table 1.

Synthetic Example of Polymer 7

Xylene (200 parts) was placed in a reaction container equipped with a stirrer, a condenser, a thermometer and a nitrogen inlet pipe, and was refluxed under a nitrogen stream.

Next, 5-vinylsalicylic acid (9.0 parts), styrene (75.0 parts), 2-ethylhexyl acrylate (16.0 parts) and dimethyl-2,2'-azobis(2-methyl propionate) (5.0 parts)

were mixed, and were added dropwise in the reaction container with stirring. The solution was kept for 10 hours. The solvent was then distilled off by distillation, and the resultant was dried under reduced pressure at 40° C. to prepare Polymer 7.

Synthetic Examples of Polymers 8 and 9

The synthesis was performed in the same manner as in Synthetic Example of Polymer 7 except the changes as follows.

Polymer 8:

5-Vinylsalicylic acid (9.0 parts) was replaced by phthalic acid-1-vinyl (5.3 parts).

Polymer 9:

5-Vinylsalicylic acid (9.0 parts) was replaced by 1-vinylnaphthalene-2-carboxylic acid (10.9 parts).

Synthesis Example of Polymer 10

Xylene (200 parts) was placed in a reaction container equipped with a stirrer, a condenser, a thermometer and a nitrogen inlet pipe, and was refluxed under a nitrogen stream. The following monomers, i.e., 2-acrylamido-2-methylpropane sulfonate (6.0 parts)
styrene (72.0 parts) and
2-ethylhexyl acrylate (18.0 parts)

were mixed, and were added dropwise in the reaction container with stirring. The solution was kept for 10 hours. The solvent was then distilled off by distillation, and the resultant was dried under reduced pressure at 40° C. to prepare Polymer 10.

Synthetic Example of Polymer 11

In a reaction container equipped with a nitrogen inlet pipe, a dewatering pipe, a stirrer and a thermocouple, bisphenol A propylene oxide 2 mol adduct (500 parts),
terephthalic acid (154 parts),
fumaric acid (45 parts) and
tin octylate (2 parts)

were placed, and were subjected to polycondensation reaction at a temperature of 230° C. for eight hours. Further, the polycondensation reaction was continued at 8 kPa over one hour. The reaction product was cooled to 160° C. to form a polyester resin. Acrylic acid (10 parts) was then added at a temperature of 160° C., and was mixed with the polyester resin. After the mixture was kept for 15 minutes, a mixture of styrene (142 parts),
n-butyl acrylate (35 parts) and
a polymerization initiator (di-t-butyl peroxide) (10 parts)

was added dropwise through a dropping funnel over one hour. An addition polymerization reaction was performed over one hour while the temperature was kept at 160° C. The product was then heated to 200° C., and was kept at 10 kPa for one hour to prepare Polymer 11.

The physical properties of Polymers 1 to 11 are shown in Table 1.

TABLE 1

| | Polymerizable monomer M | | | | | | Content of monovalent group a represented by | Acid dissociation |
|---|---|---|---|---|---|---|---|---|
| | Type | Amount added (g) | St | 2EHA | Initiator | Tg (° C.) | Structural formula (1) (μ mol/g) | constant pKa |
| Polymer 1 | Polymerizable monomer M-1 | 9.9 | 60.1 | 0.0 | 2.1 | 105.6 | 445 | 7.2 |
| Polymer 2 | Polymerizable monomer M-2 | 9.2 | 60.8 | 0.0 | 2.1 | 105.0 | 477 | 7.3 |
| Polymer 3 | Polymerizable monomer M-3 | 8.4 | 61.6 | 0.0 | 2.1 | 104.1 | 415 | 7.7 |
| Polymer 4 | Polymerizable monomer M-4 | 8.4 | 61.6 | 0.0 | 2.1 | 103.5 | 438 | 7.8 |
| Polymer 5 | Polymerizable monomer M-1 | 9.0 | 45.8 | 15.2 | 2.1 | 69.5 | 421 | 7.1 |
| Polymer 6 | Polymerizable monomer M-2 | 7.6 | 46.9 | 15.5 | 2.1 | 70.2 | 439 | 7.3 |
| Polymer 7 | Described in the specification | | | | | 75.2 | 0 | 6.6 |
| Polymer 8 | Described in the specification | | | | | 85.6 | 0 | 8.1 |
| Polymer 9 | Described in the specification | | | | | 91.4 | 0 | 8.8 |
| Polymer 10 | Described in the specification | | | | | 68.9 | 0 | −0.6 |
| Polymer 11 | Described in the specification | | | | | 58.1 | 0 | 5.5 |

Production Example of Aqueous Dispersion of Resin Particle 1

Methyl ethyl ketone (200.0 parts by mass) was placed in a reaction container equipped with a stirrer, a condenser, a thermometer and a nitrogen inlet pipe, and Polymer 1 (100.0 parts) was added, and was dissolved. A 1.0 mol/L potassium hydroxide aqueous solution was slowly added, and was stirred for 10 minutes. Ion exchange water (500.0 parts) was slowly added dropwise to emulsify the solution.

The emulsified product was distilled under reduced pressure to remove the solvent, and ion exchange water was added to adjust the concentration of the resin to 20%. An aqueous dispersion of Resin particle 1 was prepared. The physical properties of the aqueous dispersion of the resin particle are shown in Table 2.

Production Examples of Aqueous Dispersions of Resin Particles 2 to 11

Aqueous dispersions of Resin particles 2 to 11 were prepared in the same manner as in Production Example of Resin particle 1 except that Polymer 1 was replaced by another polymer and the amount of the 1.0 mol/L potassium hydroxide aqueous solution was varied as shown in Table 2.

The physical properties of the aqueous dispersions of Resin particles 2 to 11 are shown in Table 2.

TABLE 2

| Aqueous dispersion | Type of polymers | KOH content (parts) | Particle diameter D50 (nm) |
|---|---|---|---|
| Resin particle 1 | Polymer 1 | 30.9 | 66 |
| Resin particle 2 | Polymer 2 | 45.1 | 50 |
| Resin particle 3 | Polymer 3 | 32.2 | 96 |
| Resin particle 4 | Polymer 4 | 29.5 | 58 |
| Resin particle 5 | Polymer 5 | 39.7 | 66 |
| Resin particle 6 | Polymer 6 | 41.5 | 72 |
| Resin particle 7 | Polymer 7 | 49.9 | 72 |
| Resin particle 8 | Polymer 8 | 43.7 | 84 |
| Resin particle 9 | Polymer 9 | 43.7 | 78 |
| Resin particle 10 | Polymer 10 | 35.4 | 56 |
| Resin particle 11 | Polymer 11 | 28.6 | 56 |

Example 1

Dispersion Liquid Preparing Step

A 0.1 mol/L $Na_3PO_4$ aqueous solution (850.0 parts) was placed in a container equipped with a high-speed stirrer Clearmix (manufactured by M Technique Co., Ltd.). The number of rotations was adjusted to 15000 rpm, and the container was heated to 60° C. A 1.0 mol/L $CaCl_2$ aqueous solution (68.0 parts) was added thereto to prepare an aqueous medium containing a fine, poorly water-soluble dispersant $Ca_3(PO_4)_2$. After stirring for 30 minutes, a 1.0 mol/L HCl aqueous solution was added to adjust the pH of the aqueous medium to 6.0.

The materials listed below were dissolved with stirring at 100 rpm using a propeller type stirrer to prepare a dissolution solution.

styrene (72.0 parts)
n-butyl acrylate (28.0 parts)
saturated polyester resin (4.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 15000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg of the product was measured. Tg was 52.5° C.

(pH Controlling Step)

The dispersion liquid of toner base particles (500.0 parts) (solid content: 100.0 parts) was placed in a reaction container equipped with a reflux cooling tube, a stirrer and a thermometer, and was heated with an oil bath heater to a temperature of 80° C. While the dispersion liquid was being stirred, a 1.0 mol/L potassium hydroxide aqueous solution (pH controlling agent) was added to control the pH to 9.0. After the control of the pH, a small amount of the dispersion liquid of toner base particles was extracted, and the zeta potential was measured. The zeta potential was −18.5 mV.

(Resin Particle Adding Step)

While the dispersion liquid of toner base particles having a controlled pH was kept at 80° C. (temperature during addition) and was being stirred at 200 rpm, the aqueous dispersion of Resin particle 1 (2.5 parts, solid content: 0.5 parts) was slowly added. Another aqueous dispersion of Resin particle 1 was separately prepared, and the pH of the aqueous dispersion of Resin particle 1 was adjusted to the pH of the dispersion liquid of toner base particles (pH: 9.0), which was controlled in the pH controlling step. The zeta potential was then measured. The zeta potential was −79.5 mV.

(Adhesion of Resin Particles)

Next, the dispersion liquid of toner base particles containing the resin particles was continuously stirred at 80° C. (temperature during adhesion) for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 1.

Hydrophobic silica fine powder (2.0 parts) was mixed with Toner particle 1 (100.0 parts) in a Henschel mixer (manufactured by NIPPON COKE & ENGINEERING CO., LTD.) at 3000 rpm for 15 minutes to prepare Toner 1. The hydrophobic silica fine powder used as a fluidity improver was treated with dimethylsilicone oil (20% by mass), and had the number average size of primary particles of 10 nm and a BET specific surface area of 170 $m^2/g$.

Examples 2 to 21, 32 and 33, and Comparative Examples 1 to 3

Toners 2 to 21, 32, 33 and 37 to 39 were prepared in the same manner as in Example 1 except that the pH controlling step, the resin particle adding step and the adhering step in Example 1 were varied as shown in Table 3.

Example 22

Dispersion Liquid Preparing Step

A dispersion liquid of toner base particles was prepared in the same manner as in Example 1.

(Resin Particle Adding Step)

The dispersion liquid of toner base particles (500.0 parts by mass, solid content: 100.0 parts) was placed in a reaction container equipped with a reflux cooling tube, a stirrer and a thermometer, and was heated with an oil bath heater to a temperature of 80° C. (temperature during addition). While the dispersion liquid was kept at 80° C. and being stirred at 200 rpm, an aqueous dispersion of Resin particle 2 (2.5 parts, solid content: 0.5 parts) was slowly added.

(pH Controlling Step)

While the dispersion liquid of toner base particles containing the resin particles was kept at 80° C. and being stirred at 200 rpm, a 1.0 mol/L potassium hydroxide aqueous solution (pH controlling agent) was added to control the pH to 9.0.

Another dispersion liquid of toner base particles and another aqueous dispersion of Resin particle 2 were separately prepared, and the pHs of these were controlled to 9.0. The zeta potentials were measured. The zeta potential of the toner base particles was −18.5 mV and the zeta potential of Resin particle 2 was −80.8 mV.

(Adhesion of Resin Particles)

The dispersion liquid of toner base particles containing the resin particles and having the controlled pH was continuously stirred at 80° C. (temperature during adhesion) for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 22.

Hydrophobic silica fine powder (2.0 parts) was mixed with Toner particle 22 (100.0 parts) in a Henschel mixer (manufactured by NIPPON COKE & ENGINEERING CO., LTD.) at 3000 rpm for 15 minutes to prepare Toner 22. The hydrophobic silica fine powder used as a fluidity improver was treated with dimethylsilicone oil (20% by mass), and had the number average size of primary particles of 10 nm and a BET specific surface area of 170 $m^2/g$.

Example 23

Dispersion Liquid Preparing Step

A dispersion liquid of toner base particles was prepared in the same manner as in Example 1.

(Resin Particle Adding Step)

The dispersion liquid of toner base particles (500.0 parts, solid content: 100.0 parts) was placed in a reaction container equipped with a reflux cooling tube, a stirrer and a thermometer, and was heated with an oil bath heater to a temperature of 80° C. While the dispersion liquid was being stirred at 200 rpm, the aqueous dispersion of Resin particle 2 (2.5 parts, solid content: 0.5 parts) was slowly added.

(Adhesion of Resin Particles)

The pH controlling step was skipped, and the dispersion liquid was continuously stirred at 80° C. (temperature during adhesion) for one hour (the pH at this time was 6.0). The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 23.

Another dispersion liquid of toner base particles and another aqueous dispersion of Resin particle 2 were separately prepared, and the pHs of these were controlled to 6.0. The zeta potentials were measured. The zeta potential of the toner base particle was −2.5 mV and the zeta potential of Resin particle 2 was −63.3 mV.

Hydrophobic silica fine powder (2.0 parts) was mixed with Toner particle 23 (100.0 parts) in a Henschel mixer (manufactured by NIPPON COKE & ENGINEERING CO., LTD.) at 3000 rpm for 15 minutes to prepare Toner 23. The hydrophobic silica fine powder used as a fluidity improver was treated with dimethylsilicone oil (20% by mass), and had the number average size of primary particles of 10 nm and a BET specific surface area of 170 $m^2/g$.

Example 24

Dispersion Liquid Preparing Step

A dispersion liquid of toner base particles was prepared in the same manner as in Example 1 except that the 1.0 mol/L $CaCl_2$ aqueous solution used in (Dispersion liquid preparing step) in Example 1 was replaced by a 0.7 mol/L $AlCl_3$ aqueous solution.

Toner 24 was prepared in the same manner as in Example 1 except that in the steps subsequent to the pH controlling step, the aqueous dispersion of Resin particle 1 was replaced by an aqueous dispersion of Resin particle 2.

Example 25

Dispersion Liquid Preparing Step

A dispersion liquid of toner base particles was prepared in the same manner as in Example 1 except that the 1.0 mol/L $CaCl_2$ aqueous solution used in (Dispersion liquid preparing step) in Example 1 was replaced by a 1.0 mol/L $MgCl_2$ aqueous solution.

Toner 25 was prepared in the same manner as in Example 1 except that in the steps subsequent to the pH controlling step, the aqueous dispersion of Resin particle 1 (solid content: 0.5 parts) was replaced by an aqueous dispersion of Resin particle 2 (solid content: 0.5 parts).

Example 26

Dispersion Liquid Preparing Step

Calcium chloride (13.2 parts) was dissolved in ion exchange water (250 parts) to prepare an aqueous solution. The aqueous solution was placed in a container equipped with a high-speed stirrer Clearmix (manufactured by M Technique Co., Ltd.). The number of rotations was adjusted to 18000 rpm. An aqueous solution prepared by dissolving sodium hydroxide (4.8 parts) in ion exchange water (50 parts) was gradually added to the container with stirring to prepare a calcium hydroxide colloid (poorly water-soluble metal hydroxide colloid) dispersion liquid. The pH was controlled to 6.0.

The materials listed below were dissolved with a propeller type stirrer at 100 rpm to prepare a dissolution solution:

styrene (72.0 parts)

n-butyl acrylate (28.0 parts)

saturated polyester resin (4.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium (calcium hydroxide colloid dispersion liquid), and was granulated at a temperature of 60° C. for 15 minutes while Clearmix was operated at 18000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg of the product was measured. Tg was 53.1° C.

Toner 26 was prepared in the same manner as in Example 1 except that in the steps subsequent to the pH controlling step, the aqueous dispersion of Resin particle 1 was replaced by an aqueous dispersion of Resin particle 2.

Example 27

Toner 27 was prepared in the same manner as in Example 26 except that calcium chloride (13.2 parts) in Example 26 was replaced by aluminum chloride (10.5 parts).

Example 28

Toner 28 was prepared in the same manner as in Example 26 except that calcium chloride (13.2 parts) in Example 26 was replaced by magnesium chloride (11.3 parts)

Example 29

Sodium carbonate (12.6 parts) was dissolved in ion exchange water (250 parts) to prepare an aqueous solution. The aqueous solution was placed in a container equipped with a high-speed stirrer Clearmix (manufactured by M Technique Co., Ltd.). The number of rotations was adjusted to 18000 rpm. An aqueous solution prepared by dissolving calcium chloride (13.2 parts) in ion exchange water (50 parts) was added to the container at once with stirring. After stirring for 30 minutes, the pH was controlled to 6.0 to prepare an aqueous medium containing calcium carbonate.

The materials listed below were dissolved with a propeller type stirrer at 100 rpm to prepare a dissolution solution:

styrene (72.0 parts)

n-butyl acrylate (28.0 parts)

saturated polyester resin (4.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 18000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (500.0 parts) was added. The refluxing pipe was detached, and a distillator was attached. Distillation was performed for five hours at an inner temperature of the container of 100° C. The distillation fraction was 500.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg of the product was measured. Tg was 52.3° C.

Toner 29 was prepared in the same manner as in Example 1 except that in the steps subsequent to the pH controlling step, the aqueous dispersion of Resin particle 1 was replaced by an aqueous dispersion of Resin particle 2.

Example 30

Toner 30 was prepared in the same manner as in Example 29 except that calcium chloride (13.2 parts) in Example 29 was replaced by aluminum chloride (10.5 parts).

Example 31

Toner 31 was prepared in the same manner as in Example 29 except that calcium chloride (13.2 parts) in Example 29 was replaced by magnesium chloride (11.3 parts).

Example 34

Dispersion Liquid Preparing Step

A 0.1 mol/L $Na_3PO_4$ aqueous solution (850.0 parts) was added to a container equipped with a high-speed stirrer Clearmix (manufactured by M Technique Co., Ltd.), the number of rotations was adjusted to 15000 rpm, and the aqueous solution was heated to 60° C. A 1.0 mol/L $CaCl_2$ aqueous solution (68.0 parts) was added thereto to prepare an aqueous medium containing a fine poorly water-soluble dispersant $Ca_3(PO_4)_2$. After stirring for 30 minutes, a 1.0 mol/L HCl aqueous solution was added to adjust the pH of the aqueous medium to 6.0.

The materials listed below were dissolved with a propeller type stirrer at 100 rpm to prepare a dissolution solution:

styrene (72.0 parts)

n-butyl acrylate (28.0 parts)

saturated polyester resin (4.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 15000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. Then, 10% hydrochloric acid was added, and the pH was controlled to 1.0. After stirring for two hours, and then filtration, the product was sufficiently washed with ion exchange water, and was dried to prepare toner base particles. The glass transition temperature Tg of the product was measured. Tg was 52.5° C.

The toner base particles (100 parts) were dispersed in a 0.2% by mass sulfonic acid anion surfactant (manufactured by Dai-ichi Kogyo Seiyaku Co., Ltd.: NEOGEN RK) aqueous solution (400 parts) to prepare a dispersion liquid of toner base particles.

The dispersion liquid of toner base particles had a pH of 7.5.

(pH Controlling Step)

The dispersion liquid of toner base particles (500.0 parts, solid content: 100.0 parts) was placed in a reaction container equipped with a reflux cooling tube, a stirrer and a thermometer. A 1.0 mol/L potassium hydroxide aqueous solution (pH controlling agent) was added with stirring at 25° C. to control the pH of the dispersion liquid to 9.0. After the control of the pH, a small amount of the dispersion liquid of toner base particles was extracted, and the zeta potential was measured. The zeta potential was −76.5 mV.

(Resin Particle Adding Step)

While the dispersion liquid of toner base particles having the controlled pH was being stirred at 25° C. (temperature during addition) at 200 rpm, an aqueous dispersion of Resin particle 2 (2.5 parts, solid content: 0.5 parts) was slowly added. Another aqueous dispersion of Resin particle 2 was separately prepared. The pH of the aqueous dispersion of Resin particle 2 was adjusted to the same pH as that of the dispersion liquid of toner base particle (pH: 9.0) controlled in the pH controlling step, and the zeta potential was measured. The zeta potential was −80.8 mV.

(Adhesion of Resin Particles)

A 1% by mass calcium chloride aqueous solution (3.0 parts) was slowly added to the dispersion liquid. The dispersion liquid was heated with an oil bath heater to 80° C. (temperature during adhesion), and was continuously stirred for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 34.

Hydrophobic silica fine powder (2.0 parts) was mixed with Toner particle 34 (100.0 parts) using a Henschel mixer (manufactured by NIPPON COKE & ENGINEERING CO., LTD.) at 3000 rpm for 15 minutes to prepare Toner 34. The hydrophobic silica fine powder used as a fluidity improver was treated with dimethylsilicone oil (20% by mass), and had the number average size of primary particles of 10 nm and a BET specific surface area of 170 $m^2/g$.

Example 35

Dispersion Liquid Preparing Step

A 0.1 mol/L $Na_3PO_4$ aqueous solution (850.0 parts) was added to a container equipped with a high-speed stirrer Clearmix (manufactured by M Technique Co., Ltd.), the number of rotations was adjusted to 15000 rpm, and the aqueous solution was heated to 60° C. A 1.0 mol/L $CaCl_2$ aqueous solution (68.0 parts) was added thereto to prepare an aqueous medium containing a fine poorly water-soluble dispersant $Ca_3(PO_4)_2$. After stirring for 30 minutes, a 1.0 mol/L HCl aqueous solution was added to adjust the pH of the aqueous medium to 6.0.

The materials listed below were dissolved with a propeller type stirrer at 100 rpm to prepare a dissolution solution:

styrene (72.0 parts)

n-butyl acrylate (28.0 parts)

saturated polyester resin (4.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 15000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. Then, 10% hydrochloric acid was added, and the pH was controlled to 1.0. After stirring for two hours, and then filtration, the product was sufficiently washed with ion exchange water, and was dried to prepare toner base particles. The glass transition temperature Tg of the product was measured. Tg was 52.5° C.

A 0.1 mol/L $Na_3PO_4$ aqueous solution (250.0 parts) was added to a container equipped with a high-speed stirrer Clearmix (manufactured by M Technique Co., Ltd.), the number of rotations was adjusted to 15000 rpm, and the aqueous solution was heated to 60° C. A 1.0 mol/L $CaCl_2$ aqueous solution (20.0 parts) was added thereto to prepare an aqueous medium containing a fine poorly water-soluble dispersant $Ca_3(PO_4)_2$. After stirring for 30 minutes, a 1.0 mol/L HCl aqueous solution was added to adjust the pH of the aqueous medium to 6.0. Toner base particles (100.0 parts) were added to the aqueous medium, and were dispersed at a temperature of 60° C. with Clearmix at 15000 rpm for 15 minutes to prepare a dispersion liquid of toner base particles.

(pH Controlling Step)

The dispersion liquid of toner base particles (solid content: 100.0 parts) was placed in a reaction container equipped with a reflux cooling tube, a stirrer and a thermometer, and was heated with an oil bath heater to a temperature of 80° C. While the dispersion liquid was being stirred, a 1.0 mol/L potassium hydroxide aqueous solution (pH controlling agent) was added to control the pH of the dispersion liquid to 9.0. After the control of the pH, a small amount of the dispersion liquid of toner base particles was extracted, and the zeta potential was measured. The zeta potential was −65.1 mV.

(Resin Particle Adding Step)

While the dispersion liquid of toner base particles having the controlled pH was kept at 80° C. (temperature during addition) and was being stirred at 200 rpm, an aqueous dispersion of Resin particle 2 (2.5 parts, solid content: 0.5 parts) was slowly added. Another aqueous dispersion of Resin particle 2 was separately prepared. The pH of the aqueous dispersion of Resin particle 2 was adjusted to the same pH as that of the dispersion liquid of toner base particles (pH: 9.0) controlled in the pH controlling step, and the zeta potential was measured. The zeta potential was −80.8 mV.

(Adhesion of Resin Particle)

The dispersion liquid of toner base particles containing the resin particles was continuously stirred at 80° C. (temperature during adhesion) for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 35.

Hydrophobic silica fine powder (2.0 parts) was mixed with Toner particle 35 (100.0 parts) in a Henschel mixer (manufactured by NIPPON COKE & ENGINEERING CO., LTD.) at 3000 rpm for 15 minutes to prepare Toner 35. The hydrophobic silica fine powder used as a fluidity improver was treated with dimethylsilicone oil (20% by mass), and had the number average size of primary particles of 10 nm and a BET specific surface area of 170 $m^2/g$.

Example 36

A toner was produced by dissolution suspension according to the following procedure.

(Dispersion Liquid Preparing Step)

Water (660.0 parts) and a 48.5% by mass sodium dodecyl diphenyl ether disulfonate aqueous solution (25.0 parts by mass) were mixed with stirring, and stirred with a TK homomixer (manufactured by PRIMIX Corporation) at 10000 rpm to prepare an aqueous medium.

The materials listed below were added to ethyl acetate (500 parts), and were dissolved with a propeller type stirrer at 100 rpm to prepare a dissolution solution:

copolymer of styrene and n-butyl acrylate (copolymerization ratio: styrene/n-butyl acrylate=72/28, Mp=17000) (100.0 parts)

saturated polyester resin (4.0 parts)
(terephthalic acid-propylene oxide modified bisphenol A copolymer, acid value: 13 mgKOH/g, Mw: 14500)

C.I. Pigment Blue 15:3 (6.5 parts)

hydrocarbon wax having a peak temperature of 77° C. as the largest endothermic peak (HNP-51, manufactured by NIPPON SEIRO CO., LTD.) (9.0 parts)

The aqueous medium (150.0 parts) was placed in a container, and was stirred with a TK homomixer (manufactured by PRIMIX Corporation) at the number of rotations of 12000 rpm. The dissolution solution (100 parts) was added thereto, and was mixed therewith for 10 minutes to prepare an emulsion slurry.

The emulsion slurry (100 parts by mass) was placed in a flask equipped with a degassing pipe, a stirrer and a thermometer. While the emulsion slurry was being stirred at a stirring circumferential speed of 20 m/min, the solvent was removed at 30° C. under reduced pressure for 12 hours. The product was aged at 45° C. for four hours to prepare a slurry containing no solvent. The slurry was filtered under reduced pressure. To the filtered cake, ion exchange water (300.0 parts) was added, and was mixed with a TK homomixer to be dispersed again (at the number of rotations of 12000 rpm for 10 minutes). The mixture was filtered. The filtered cake was dried in a dryer at 45° C. for 48 hours, and was sieved with a mesh having an opening of 75 μm to prepare toner base particles. The toner base particles were partially extracted. The glass transition temperature Tg was measured. Tg was 51.1° C.

A 0.1 mol/L $Na_3PO_4$ aqueous solution (850.0 parts) was added to a container equipped with a high-speed stirrer Clearmix (manufactured by M Technique Co., Ltd.), the number of rotations was adjusted to 15000 rpm, and the aqueous solution was heated to 60° C. A 1.0 mol/L $CaCl_2$ aqueous solution (68.0 parts) was added thereto to prepare an aqueous medium containing a fine poorly water-soluble dispersant $Ca_3(PO_4)_2$. After stirring for 30 minutes, a 1.0 mol/L HCl aqueous solution was added to adjust the pH of the aqueous medium to 6.0.

The toner base particles (250.0 parts) were added to the aqueous medium, and were dispersed at a temperature of 60° C. for 15 minutes while Clearmix was operated at 15000 rpm. Ion exchange water was added to adjust the concentration of the toner base particles in the dispersion liquid to 20%. A dispersion liquid of toner base particles was prepared.

(pH Controlling Step)

The dispersion liquid of toner base particles (500.0 parts, solid content: 100.0 parts) was placed in a reaction container equipped with a reflux cooling tube, a stirrer and a thermometer, and was heated to a temperature of 80° C. with an oil bath heater. While the dispersion liquid was being stirred, a 1.0 mol/L potassium hydroxide aqueous solution (pH controlling agent) was added to control the pH of the dispersion liquid to 9.0. After the control of the pH, a small amount of the dispersion liquid of toner base particles was extracted, and the zeta potential was measured. The zeta potential was −35.1 mV.

(Resin Particle Adding Step)

While the dispersion liquid of toner base particles having the controlled pH was kept at 80° C. (temperature during addition) and was being stirred at 200 rpm, an aqueous dispersion of Resin particle 2 (2.5 parts, solid content: 0.5 parts) was slowly added. Another aqueous dispersion of Resin particle 2 was separately prepared. The pH of the aqueous dispersion of Resin particle 2 was adjusted to the same pH as that of the dispersion liquid of toner base particle (pH=9.0) controlled in the pH controlling step, and the zeta potential was measured. The zeta potential was −80.8 mV.

(Adhesion of Resin Particles)

The dispersion liquid of toner base particles containing the resin particles was continuously stirred at 80° C. (temperature during adhesion) for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 36.

Hydrophobic silica fine powder (2.0 parts) was mixed with Toner particle 36 (100.0 parts) in a Henschel mixer (manufactured by NIPPON COKE & ENGINEERING CO., LTD.) at 3000 rpm for 15 minutes to prepare Toner 36. The hydrophobic silica fine powder used as a fluidity improver was treated with dimethylsilicone oil (20% by mass), and had the number average size of primary particles of 10 nm and a BET specific surface area of 170 $m^2/g$.

Comparative Example 4

Dispersion Liquid Preparing Step

A dispersion liquid of toner base particles was prepared in the same manner as in Example 1.

(Resin Particle Adding Step)

The dispersion liquid of toner base particles (500.0 parts by mass, solid content: 100.0 parts) was placed in a reaction container equipped with a reflux cooling tube, a stirrer and a thermometer. While the dispersion liquid was being stirred at 25° C. (temperature during addition) and 200 rpm, an aqueous dispersion of Resin particle 2 (2.5 parts, solid content: 0.5 parts) was slowly added.

(pH Controlling Step)

While the dispersion liquid of toner base particles containing the resin particles was being stirred at 25° C. (temperature during control of the pH) and 200 rpm, a 1.0 mol/L hydrochloric acid (pH controlling agent) was added to control the pH of the dispersion liquid to 1.5.

Another dispersion liquid of toner base particles and another aqueous dispersion of Resin particle 2 were separately prepared, and the pHs of these were controlled to 1.5. The zeta potentials were measured. The zeta potential of the toner base particle was 16.5 mV and the zeta potential of Resin particle 2 was 11.3 mV.

(Adhesion of Resin Particles)

Next, the dispersion liquid of toner base particles containing the resin particles and having the controlled pH was heated to a temperature of 60° C. (temperature during adhesion) with an oil bath heater, and was continuously stirred for one hour. The dispersion liquid was then cooled to 20° C., and 10% hydrochloric acid was added to control the pH to 1.0. The dispersion liquid was stirred for two hours, and was filtered. The product was sufficiently washed with ion exchange water, was dried, and was classified to prepare Toner particle 40.

Hydrophobic silica fine powder (2.0 parts) was mixed with Toner particle 40 (100.0 parts) in a Henschel mixer (manufactured by NIPPON COKE & ENGINEERING CO., LTD.) at 3000 rpm for 15 minutes to prepare Toner 40. The hydrophobic silica fine powder used as a fluidity improver was treated with dimethylsilicone oil (20% by mass), and had the number average size of primary particles of 10 nm and a BET specific surface area of 170 $m^2/g$.

Comparative Example 5

A 0.1 mol/L $Na_3PO_4$ aqueous solution (850.0 parts by mass) was added to a container equipped with a high-speed stirrer Clearmix (manufactured by M Technique Co., Ltd.), the number of rotations was adjusted to 15000 rpm, and the aqueous solution was heated to 60° C. A 1.0 mol/L $CaCl_2$ aqueous solution (68.0 parts) was added thereto to prepare an aqueous medium containing a fine poorly water-soluble dispersant $Ca_3(PO_4)_2$. After stirring for 30 minutes, a 1.0 mol/L HCl aqueous solution was added to adjust the pH of the aqueous medium to 6.0.

The materials listed below were dissolved with a propeller type stirrer at 100 rpm to prepare a dissolution solution:

styrene (72.0 parts)

n-butyl acrylate (28.0 parts)

saturated polyester resin (4.0 parts)

(terephthalic acid-propylene oxide modified bisphenol A copolymer, acid value: 13 mgKOH/g, Mw: 14500)

Polymer 1 (1.0 part)

Next, the materials listed below were added to the dissolution solution:

C.I. Pigment Blue 15:3 (6.5 parts)

ester wax (10.0 parts)

(main component: $C_{21}H_{43}COOC_{22}H_{45}$, melting point: 72.5° C.)

The dissolution solution having the materials above was heated to a temperature of 60° C., and was stirred with a TK homomixer (manufactured by PRIMIX Corporation) at 9000 rpm to dissolve components soluble in styrene or n-butyl acrylate and disperse insoluble components.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 15000 rpm.

The product was placed in a propeller type stirrer equipped with a refluxing pipe, a thermometer and a nitrogen inlet pipe, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C., and 10% hydrochloric acid was added to control the pH to 1.0. After stirring for two hours, and then filtration, the product was sufficiently washed with ion exchange water, and was dried to prepare Toner particle 41.

Hydrophobic silica fine powder (2.0 parts) was mixed with Toner particle 41 (100.0 parts) in a Henschel mixer (manufactured by NIPPON COKE & ENGINEERING CO., LTD.) at 3000 rpm for 15 minutes to prepare Toner 41. The hydrophobic silica fine powder used as a fluidity improver was treated with dimethylsilicone oil (20% by mass), and had the number average size of primary particles of 10 nm and a BET specific surface area of 170 $m^2/g$.

As for the toners prepared in Examples 1 to 21 and 23 to 36 and Comparative Examples 1 to 3 and 5, conditions for the production of each toner are shown in Table 3.

As for the toners prepared in Example 22 and Comparative Example 4, conditions for the production of each toner are shown in Table 4.

TABLE 3

| | | Dispersion liquid preparing step | | pH controlling step | | | Resin particle adding step | | | | | Adhering step | | | | |
|---|---|---|---|---|---|---|---|---|---|---|---|---|---|---|---|---|
| | | Dispersion stabilizer | pH | pH controlling agent | Controlled pH | Temperature during control of pH (° C.) | Type of resin particles | pKa of resin | Amount added (parts by mass) | Solid content (parts by mass) | Temperature during addition (° C.) | Temperature during adhesion (° C.) | Zeta potential of toner base particles (mV) | Zeta potential of resin particles (mV) | Difference in zeta potential (toner base particles – resin particles) (mV) | pH – pKa |
| Example 1 | Toner 1 | Calcium phosphate | 6.0 | 1N KOH aqueous solution | 9.0 | 80 | Resin particle 1 | 7.2 | 2.50 | 0.50 | 80 | 80 | −18.5 | −79.5 | 61.0 | 1.8 |
| Example 2 | Toner 2 | Calcium phosphate | 6.0 | 1N KOH aqueous solution | 9.0 | 80 | Resin particle 2 | 7.3 | 2.50 | 0.50 | 80 | 80 | −18.5 | −80.8 | 62.3 | 1.7 |
| Example 3 | Toner 3 | Calcium phosphate | 6.0 | 1N KOH aqueous solution | 9.0 | 80 | Resin particle 2 | 7.3 | 0.50 | 0.10 | 80 | 80 | −18.5 | −80.8 | 62.3 | 1.7 |
| Example 4 | Toner 4 | Calcium phosphate | 6.0 | 1N KOH aqueous solution | 9.0 | 80 | Resin particle 2 | 7.3 | 1.25 | 0.25 | 80 | 80 | −18.5 | −80.8 | 62.3 | 1.7 |
| Example 5 | Toner 5 | Calcium phosphate | 6.0 | 1N KOH aqueous solution | 9.0 | 80 | Resin particle 2 | 7.3 | 5.00 | 1.00 | 80 | 80 | −18.5 | −80.8 | 62.3 | 1.7 |
| Example 6 | Toner 6 | Calcium phosphate | 6.0 | 1N KOH aqueous solution | 9.0 | 80 | Resin particle 2 | 7.3 | 15.00 | 3.00 | 80 | 80 | −18.5 | −80.8 | 62.3 | 1.7 |
| Example 7 | Toner 7 | Calcium phosphate | 6.0 | 1N KOH aqueous solution | 9.0 | 80 | Resin particle 2 | 7.3 | 25.00 | 5.00 | 80 | 80 | −18.5 | −80.8 | 62.3 | 1.7 |
| Example 8 | Toner 8 | Calcium phosphate | 6.0 | 1N KOH aqueous solution | 9.0 | 80 | Resin particle 3 | 7.7 | 2.50 | 0.50 | 80 | 80 | −18.5 | −84.1 | 65.6 | 1.3 |
| Example 9 | Toner 9 | Calcium phosphate | 6.0 | 1N KOH aqueous solution | 9.0 | 80 | Resin particle 4 | 7.8 | 2.50 | 0.50 | 80 | 80 | −18.5 | −76.3 | 57.8 | 1.2 |
| Example 10 | Toner 10 | Calcium phosphate | 6.0 | 1N KOH aqueous solution | 9.0 | 65 | Resin particle 5 | 7.1 | 2.50 | 0.50 | 65 | 65 | −18.3 | −72.4 | 54.1 | 1.9 |
| Example 11 | Toner 11 | Calcium phosphate | 6.0 | 1N KOH aqueous solution | 9.0 | 70 | Resin particle 7 | 6.6 | 2.50 | 0.50 | 70 | 70 | −18.1 | −70.8 | 52.7 | 2.4 |
| Example 12 | Toner 12 | Calcium phosphate | 6.0 | 1N KOH aqueous solution | 10.0 | 80 | Resin particle 8 | 8.1 | 2.50 | 0.50 | 80 | 80 | −26.4 | −85.1 | 58.7 | 1.9 |
| Example 13 | Toner 13 | Calcium phosphate | 6.0 | 1N KOH aqueous solution | 11.0 | 80 | Resin particle 9 | 8.8 | 2.50 | 0.50 | 80 | 80 | −31.3 | −83.5 | 52.2 | 2.2 |
| Example 14 | Toner 14 | Calcium phosphate | 6.0 | 1N KOH aqueous solution | 5.5 | 80 | Resin particle 2 | 7.3 | 2.50 | 0.50 | 80 | 80 | 4.3 | −57.3 | 61.6 | −1.8 |
| Example 15 | Toner 15 | Calcium phosphate | 6.0 | 1N KOH aqueous solution | 7.5 | 80 | Resin particle 2 | 7.3 | 2.50 | 0.50 | 80 | 80 | −10.2 | −71.6 | 61.4 | 0.2 |
| Example 16 | Toner 16 | Calcium phosphate | 6.0 | 1N KOH aqueous solution | 11.0 | 80 | Resin particle 2 | 7.3 | 2.50 | 0.50 | 80 | 80 | −31.3 | −90.1 | 58.8 | 3.7 |
| Example 17 | Toner 17 | Calcium phosphate | 6.0 | 1N KOH aqueous solution | 11.5 | 80 | Resin particle 2 | 7.3 | 2.50 | 0.50 | 80 | 80 | −35.4 | −96.7 | 61.3 | 4.2 |
| Example 18 | Toner 18 | Calcium phosphate | 6.0 | 1N KOH aqueous solution | 9.0 | 40 | Resin particle 2 | 7.3 | 2.50 | 0.50 | 40 | 40 | −18.7 | −80.1 | 61.4 | 1.7 |
| Example 19 | Toner 19 | Calcium phosphate | 6.0 | 1N NaOH aqueous solution | 9.0 | 80 | Resin particle 2 | 7.3 | 2.50 | 0.50 | 80 | 80 | −18.5 | −80.5 | 62.0 | 1.7 |

TABLE 3-continued

| | | Dispersion liquid preparing step | | pH controlling step | | | Resin particle adding step | | | | | Adhering step | | | | |
|---|---|---|---|---|---|---|---|---|---|---|---|---|---|---|---|---|
| | | Dispersion stabilizer | pH | pH controlling agent | Controlled pH | Temperature during control of pH (° C.) | Type of resin particles | pKa of resin | Amount added (parts by mass) | Solid content (parts by mass) | Temperature during addition (° C.) | Temperature during adhesion (° C.) | Zeta potential of toner base particles (mV) | Zeta potential of resin particles (mV) | Difference in zeta potential (toner base particles − resin particles) (mV) | pH − pKa |
| Example 20 | Toner 20 | Calcium phosphate | 6.0 | 1N LiOH aqueous solution | 9.0 | 80 | Resin particle 2 | 7.3 | 2.50 | 0.50 | 80 | 80 | −18.5 | −79.8 | 61.3 | 1.7 |
| Example 21 | Toner 21 | Calcium phosphate | 6.0 | 1N $Na_2CO_3$ aqueous solution | 8.0 | 80 | Resin particle 2 | 7.3 | 2.50 | 0.50 | 80 | 80 | −13.6 | −76.2 | 62.6 | 0.7 |
| Example 23 | Toner 23 | Calcium phosphate | 6.0 | — | — | — | Resin particle 2 | 7.3 | 2.50 | 0.50 | 80 | 80 | −2.5 | −63.3 | 60.8 | −1.3 |
| Example 24 | Toner 24 | Aluminum phosphate | 6.0 | 1N KOH aqueous solution | 9.0 | 80 | Resin particle 2 | 7.3 | 2.50 | 0.50 | 80 | 80 | −11.5 | −80.8 | 69.3 | 1.7 |
| Example 25 | Toner 25 | Magnesium phosphate | 6.0 | 1N KOH aqueous solution | 9.0 | 80 | Resin particle 2 | 7.3 | 2.50 | 0.50 | 80 | 80 | −20.4 | −80.8 | 60.4 | 1.7 |
| Example 26 | Toner 26 | Calcium hydroxide | 6.0 | 1N KOH aqueous solution | 9.0 | 80 | Resin particle 2 | 7.3 | 2.50 | 0.50 | 80 | 80 | −36.4 | −80.8 | 44.4 | 1.7 |
| Example 27 | Toner 27 | Aluminum hydroxide | 6.0 | 1N KOH aqueous solution | 9.0 | 80 | Resin particle 2 | 7.3 | 2.50 | 0.50 | 80 | 80 | −28.2 | −80.8 | 52.6 | 1.7 |
| Example 28 | Toner 28 | Magnesium hydroxide | 6.0 | 1N KOH aqueous solution | 9.0 | 80 | Resin particle 2 | 7.3 | 2.50 | 0.50 | 80 | 80 | −34.8 | −80.8 | 46.0 | 1.7 |
| Example 29 | Toner 29 | Calcium carbonate | 6.0 | 1N KOH aqueous solution | 9.0 | 80 | Resin particle 2 | 7.3 | 2.50 | 0.50 | 80 | 80 | −30.1 | −80.8 | 50.7 | 1.7 |
| Example 30 | Toner 30 | Aluminum carbonate | 6.0 | 1N KOH aqueous solution | 9.0 | 80 | Resin particle 2 | 7.3 | 2.50 | 0.50 | 80 | 80 | −23.4 | −80.8 | 57.4 | 1.7 |
| Example 31 | Toner 31 | Magnesium carbonate | 6.0 | 1N KOH aqueous solution | 9.0 | 80 | Resin particle 2 | 7.3 | 2.50 | 0.50 | 80 | 80 | −15.8 | −80.8 | 65.0 | 1.7 |
| Example 32 | Toner 32 | Calcium phosphate | 6.0 | 1N KOH aqueous solution | 9.0 | 25 | Resin particle 2 | 7.3 | 2.50 | 0.50 | 25 | 80 | −18.2 | −80.3 | 62.1 | 1.7 |
| Example 33 | Toner 33 | Calcium phosphate | 6.0 | 1N KOH aqueous solution | 9.0 | 90 | Resin particle 6 | 7.3 | 2.50 | 0.50 | 90 | 90 | −18.4 | −81.6 | 63.2 | 1.7 |
| Example 34 | Toner 34 | NEOGEN RK | 7.5 | 1N KOH aqueous solution | 9.0 | 80 | Resin particle 2 | 7.3 | 2.50 | 0.50 | 80 | 80 | −76.5 | −80.8 | 4.3 | 1.7 |
| Example 35 | Toner 35 | Calcium phosphate | 6.0 | 1N KOH aqueous solution | 9.0 | 80 | Resin particle 2 | 7.3 | 2.50 | 0.50 | 80 | 80 | −65.1 | −80.8 | 15.7 | 1.7 |
| Example 36 | Toner 36 | Calcium phosphate | 6.0 | 1N KOH aqueous solution | 9.0 | 80 | Resin particle 2 | 7.3 | 2.50 | 0.50 | 80 | 80 | −35.1 | −80.8 | 45.7 | 1.7 |
| Comparative Example 1 | Toner 37 | Calcium phosphate | 6.0 | 1N HCl aqueous solution | 5.5 | 60 | Resin particle 10 | −0.6 | 2.50 | 0.50 | 60 | 60 | 4.3 | −40.3 | 44.6 | 6.1 |
| Comparative Example 2 | Toner 38 | Calcium phosphate | 6.0 | 1N KOH aqueous solution | 7.5 | 55 | Resin particle 11 | 5.5 | 2.50 | 0.50 | 55 | 70 | −10.4 | −76.6 | 66.2 | 2.0 |
| Comparative Example 3 | Toner 39 | Calcium phosphate | 6.0 | 1N HCl aqueous solution | 5.0 | 80 | Resin particle 2 | 7.3 | 2.50 | 0.50 | 80 | 80 | 8.1 | −53.0 | 61.1 | −2.3 |
| Comparative Example 5 | Toner 41 | Described in the specification | | | | | | | | | | | | | — | — |

TABLE 4

| | | Dispersion liquid preparing step | | Resin particle adding step | | | | | pH controlling step | | |
|---|---|---|---|---|---|---|---|---|---|---|---|
| | | Dispersion stabilizer | pH | Type of resin particles | pKa of resin | Amount added (parts by mass) | Solid content (parts by mass) | Temperature during addition (° C.) | pH controlling agent | Controlled pH | Temperature during control of pH (° C.) |
| Example 22 | Toner 22 | Calcium phosphate | 6.0 | Resin particle 2 | 7.3 | 2.50 | 0.50 | 80 | 1N KOH aqueous solution | 9.0 | 80 |
| Comparative Example 4 | Toner 40 | Calcium phosphate | 6.0 | Resin particle 7 | 6.6 | 2.50 | 0.50 | 25 | 1N HCl aqueous solution | 1.5 | 25 |

| | Adhering step | | | | |
|---|---|---|---|---|---|
| | Temperature during adhesion (° C.) | Zeta potential of toner base particles (mV) | Zeta potential of resin particles (mV) | Difference in zeta potential (toner base particles − resin particles) (mV) | pH − pKa |
| Example 22 | 80 | −18.5 | −80.8 | 62.3 | 1.7 |
| Comparative Example 4 | 70 | 16.5 | 11.3 | 5.2 | −5.1 |

The toners prepared in Examples 1 to 36 and Comparative Examples 1 to 5 were evaluated for performance according to the following methods. The results are shown in Table 5.

Figure 2:
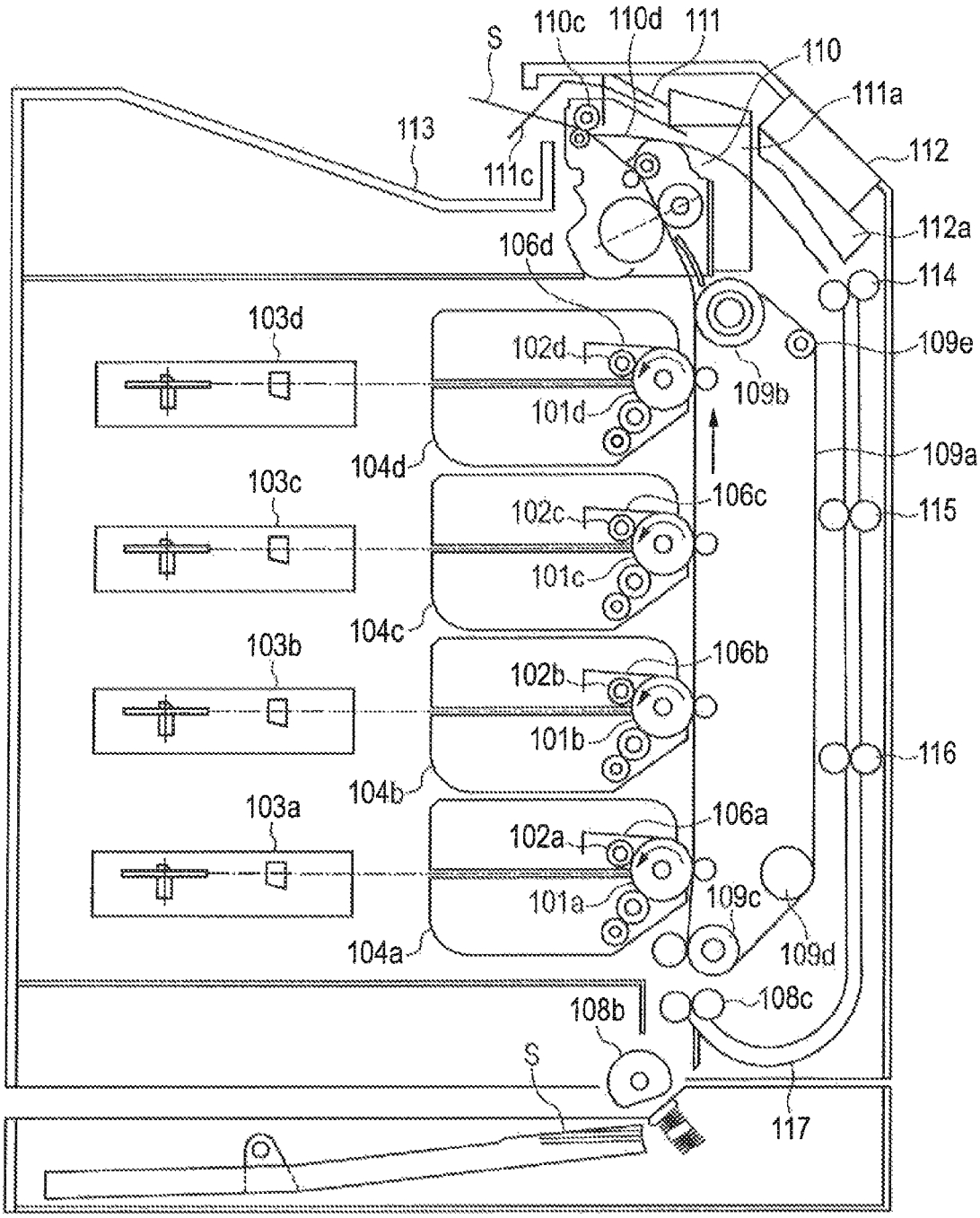
FIG. 2 is a cross sectional view of an electrophotographic apparatus using an image forming method according to the present invention.

A modified developing apparatus of a one-component contact developing system (Satera LBP5300; manufactured by Canon Inc.) illustrated in FIG. 2 was used. The transfer paper (recording medium) used was Xerox4200 (manufactured by Xerox Corporation, 75 g/m$^2$ paper). A developer container 23 in a cartridge illustrated in FIG. 1 was filled with a toner (80 g), and the cartridge was mounted on a unit 104*a* in FIG. 2.

<Evaluation of Charging Stability>

Under an environment at high temperature and high humidity (temperature: 35° C., humidity: 85% RH), a developing apparatus equipped with the cartridge was left to stand for 24 hours. A cyan monochromatic mode was selected, and the process speed was set at 200 mm/s. A solid image (image coverage rate: 10%) was continuously printed on the transfer paper such that the toner was disposed in an amount of 0.45 mg/cm$^2$, and the image density of the image was measured in the first, the 100th, and the 7000th printed papers. The image density was evaluated according to the following method.

(Method for Measuring Image Density)

The image density of a solid portion was measured with a "Macbeth reflection densitometer RD918" (manufactured by GretagMacbeth GmbH). The image density was measured as a relative density to the image density of a printed image of an original image having a white solid portion (density: 0.00).

(Criteria for Evaluation)

A: image density of 1.40 or more

B: image density of 1.30 or more and less than 1.40

C: image density of 1.20 or more and less than 1.30

D: image density of less than 1.20

<Evaluation of Durability>

Under an environment at high temperature and high humidity (temperature: 35° C., humidity: 85% RH), the developing apparatus equipped with the cartridge was left to stand for 24 hours. The cyan monochromatic mode was selected, and the process speed was set at 200 mm/s. A solid image (image coverage rate: 10%) was continuously printed on the transfer paper such that the toner was disposed in an amount of 0.30 mg/cm$^2$, and 7000 sheets were printed out. Subsequently, a halftone image was printed. The printed halftone image was evaluated on the following criteria.

(Criteria for Evaluation)

A: halftone image having no strip or 1 strip.

B: halftone image having 2 to 4 strips.

C: halftone image having 5 to 7 strips.

D: halftone image having 8 or more strips.

TABLE 5

| | | Charging stability | | | | | | Durability | |
|---|---|---|---|---|---|---|---|---|---|
| | | 1st sheet | | 100th sheet | | 7000th sheet | | | The number |
| | | Evaluation | Density | Evaluation | Density | Evaluation | Density | Evaluation | of strips |
| Example 1 | Toner 1 | A | 1.45 | A | 1.44 | A | 1.44 | A | 0 |
| Example 2 | Toner 2 | A | 1.46 | A | 1.46 | A | 1.45 | A | 0 |
| Example 3 | Toner 3 | B | 1.34 | A | 1.42 | A | 1.41 | A | 0 |
| Example 4 | Toner 4 | A | 1.43 | A | 1.42 | A | 1.42 | A | 0 |
| Example 5 | Toner 5 | A | 1.46 | A | 1.45 | A | 1.45 | A | 0 |
| Example 6 | Toner 6 | A | 1.47 | A | 1.46 | A | 1.45 | A | 0 |
| Example 7 | Toner 7 | A | 1.47 | A | 1.44 | A | 1.42 | B | 3 |
| Example 8 | Toner 8 | A | 1.43 | A | 1.44 | A | 1.43 | A | 0 |
| Example 9 | Toner 9 | A | 1.44 | A | 1.44 | A | 1.42 | A | 0 |

TABLE 5-continued

| | | Charging stability | | | | | | Durability | |
|---|---|---|---|---|---|---|---|---|---|
| | | 1st sheet | | 100th sheet | | 7000th sheet | | | The number |
| | | Evaluation | Density | Evaluation | Density | Evaluation | Density | Evaluation | of strips |
| Example 10 | Toner 10 | A | 1.44 | A | 1.44 | A | 1.43 | A | 1 |
| Example 11 | Toner 11 | B | 1.35 | A | 1.40 | B | 1.32 | A | 1 |
| Example 12 | Toner 12 | A | 1.44 | A | 1.44 | A | 1.41 | A | 0 |
| Example 13 | Toner 13 | B | 1.36 | B | 1.35 | B | 1.31 | A | 1 |
| Example 14 | Toner 14 | B | 1.34 | B | 1.32 | C | 1.25 | C | 6 |
| Example 15 | Toner 15 | A | 1.45 | A | 1.45 | A | 1.44 | A | 0 |
| Example 16 | Toner 16 | A | 1.44 | A | 1.44 | A | 1.42 | A | 1 |
| Example 17 | Toner 17 | A | 1.43 | A | 1.42 | B | 1.36 | A | 1 |
| Example 18 | Toner 18 | A | 1.43 | A | 1.42 | B | 1.30 | C | 5 |
| Example 19 | Toner 19 | A | 1.46 | A | 1.45 | A | 1.45 | A | 0 |
| Example 20 | Toner 20 | A | 1.45 | A | 1.45 | A | 1.44 | A | 0 |
| Example 21 | Toner 21 | B | 1.36 | B | 1.35 | B | 1.35 | B | 3 |
| Example 22 | Toner 22 | A | 1.43 | A | 1.4 | B | 1.35 | B | 2 |
| Example 23 | Toner 23 | B | 1.36 | B | 1.35 | B | 1.33 | C | 5 |
| Example 24 | Toner 24 | A | 1.44 | A | 1.44 | A | 1.44 | A | 0 |
| Example 25 | Toner 25 | A | 1.46 | A | 1.45 | A | 1.43 | A | 0 |
| Example 26 | Toner 26 | A | 1.43 | A | 1.43 | A | 1.41 | A | 1 |
| Example 27 | Toner 27 | A | 1.44 | A | 1.44 | A | 1.43 | A | 0 |
| Example 28 | Toner 28 | A | 1.45 | A | 1.45 | A | 1.44 | A | 0 |
| Example 29 | Toner 29 | A | 1.44 | A | 1.44 | A | 1.42 | A | 0 |
| Example 30 | Toner 30 | A | 1.45 | A | 1.44 | A | 1.43 | A | 0 |
| Example 31 | Toner 31 | A | 1.43 | A | 1.42 | A | 1.42 | A | 0 |
| Example 32 | Toner 32 | A | 1.45 | A | 1.45 | A | 1.45 | A | 0 |
| Example 33 | Toner 33 | A | 1.43 | A | 1.42 | B | 1.37 | B | 3 |
| Example 34 | Toner 34 | B | 1.33 | B | 1.30 | C | 1.23 | C | 6 |
| Example 35 | Toner 35 | B | 1.34 | A | 1.41 | B | 1.37 | B | 2 |
| Example 36 | Toner 36 | A | 1.40 | B | 1.36 | C | 1.28 | B | 2 |
| Comparative Example 1 | Toner 37 | D | 1.17 | D | 1.16 | D | 1.14 | C | 6 |
| Comparative Example 2 | Toner 38 | C | 1.21 | C | 1.24 | D | 1.14 | D | 8 |
| Comparative Example 3 | Toner 39 | B | 1.32 | C | 1.27 | D | 1.17 | D | 9 |
| Comparative Example 4 | Toner 40 | C | 1.25 | C | 1.21 | D | 1.07 | D | 13 |
| Comparative Example 5 | Toner 41 | B | 1.34 | B | 1.32 | D | 1.16 | C | 7 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-067127, filed Mar. 27, 2014, and Japanese Patent Application No. 2014-199727, filed Sep. 30, 2014, which are hereby incorporated by reference herein in their entirety.

What is claimed is:

1. A method for producing a toner particle, comprising a step of adhering a resin particle to a surface of a toner base particle in an aqueous medium, the toner base particle containing a binder resin and a colorant, wherein the resin particle contains a resin A, the resin A (i) having an ionic functional group, and (ii) satisfying the following relationship $$6.0 \leq pKa(A) \leq 9.0$$

where the acid dissociation constant of the resin A is defined as pKa(A), and wherein when a pH of the aqueous medium at the start of the step is defined as pH(W), the pKa(A) and the pH(W) satisfy a following formula:

$$pH(W) \geq pKa(A) - 2.0.$$

2. The method for producing a toner particle according to claim 1, wherein the pKa(A) is 7.0 or more and 8.5 or less.

3. The method for producing a toner particle according to claim 1, wherein the pH(W) satisfies $$pKa(A) - 2.0 \leq pH(W) \leq pKa(A) + 4.0.$$

4. The method for producing a toner particle according to claim 1, wherein in the step, the aqueous medium containing the toner base particle and the resin particle is heated to a temperature equal to or higher than the glass transition temperature of the toner base particle.

5. The method for producing a toner particle according to claim 1, further comprising a pH controlling step, wherein in the pH controlling step, the pH of the aqueous medium at the start of the step is controlled such that pH(W)≥pKa(A)−2.0 is satisfied, with a pH controlling agent containing at least one selected from the group consisting of an acid having a pKa of 3.0 or less and a base having a pKb of 3.0 or less.

6. The method for producing a toner particle according to claim 5, wherein the pH controlling agent contains a base having a pKb of 3.0 or less.

7. The method for producing a toner particle according to claim 6, wherein the base having a pKb of 3.0 or less is at least one selected from the group consisting of LiOH, NaOH and KOH.

8. The method for producing a toner particle according to claim 5, wherein the method comprises a dispersion liquid preparing step of dispersing the toner base particle in an aqueous medium to prepare a dispersion liquid of the toner base particle, the pH controlling step, a resin particle adding step of adding the resin particle to the aqueous medium, and the step in this order.

9. The method for producing a toner particle according to claim 8, wherein in the dispersion liquid preparing step, the aqueous medium contains an inorganic dispersion stabilizer.

10. The method for producing a toner particle according to claim 9, wherein the inorganic dispersion stabilizer is at least one selected from the group consisting of a calcium phosphate compound, an aluminum phosphate compound, a magnesium phosphate compound, a calcium hydroxide compound, an aluminum hydroxide compound, a magnesium hydroxide compound, a calcium carbonate compound, an aluminum carbonate compound and a magnesium carbonate compound.

11. The method for producing a toner particle according to claim 8, wherein in the resin particle adding step, the temperature of the aqueous medium is lower than the glass transition temperature of the resin particle when the resin particle is added to the aqueous medium.

12. The method for producing a toner particle according to claim 1, wherein in the step, the zeta potential of the toner base particle is higher than the zeta potential of the resin particle by 10 mV or more.

* * * * *